US007139500B2

(12) United States Patent
Kawazu et al.

(10) Patent No.: US 7,139,500 B2
(45) Date of Patent: Nov. 21, 2006

(54) IMAGE FUSING DEVICE AND IMAGE FORMING APPARATUS

(75) Inventors: Takao Kawazu, Shizuoka (JP); Atsuya Takahashi, Shizuoka (JP); Masataka Mochizuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/263,987

(22) Filed: Nov. 2, 2005

(65) Prior Publication Data

US 2006/0051122 A1 Mar. 9, 2006

Related U.S. Application Data

(62) Division of application No. 10/759,169, filed on Jan. 20, 2004.

(30) Foreign Application Priority Data

Jan. 21, 2003 (JP) ..... 2003-012586
Mar. 4, 2003 (JP) ..... 2003-056997
Apr. 1, 2003 (JP) ..... 2003-098565

(51) Int. Cl.
*G03G 15/20* (2006.01)

(52) U.S. Cl. ..... 399/69; 219/216; 399/328; 399/88; 315/291; 363/19

(58) Field of Classification Search ..... 399/320, 399/67, 69, 328, 88; 347/156; 318/98; 315/307, 291; 363/19, 125, 21.01
See application file for complete search history.

(56) References Cited

U.S. PATENT DOCUMENTS 4,556,770 A * 12/1985 Tazima et al. ..... 219/627
4,970,219 A 11/1990 Effland et al. ..... 514/339
5,444,521 A 8/1995 Tomoyuki et al. ..... 399/69
5,525,775 A 6/1996 Setoriyama et al. ..... 219/216
5,783,806 A 7/1998 Hayasaki ..... 219/635
6,359,269 B1 3/2002 Hayasaki et al. ..... 219/665
6,516,164 B1 2/2003 Kawazu ..... 399/69
6,519,426 B1 2/2003 Goto et al. ..... 399/69
2002/0003970 A1 1/2002 Goto et al. ..... 399/69
2004/0105693 A1 6/2004 Akizuki et al. ..... 399/69
2004/0222216 A1 11/2004 Kinouchi et al. ..... 219/619

FOREIGN PATENT DOCUMENTS

JP 63-313182 12/1988
JP 2-157878 6/1990
JP 4-44075 2/1992
JP 4-44076 2/1992
JP 4-44077 2/1992
JP 4-44078 2/1992

(Continued)

*Primary Examiner*—Sophia S. Chen
(74) *Attorney, Agent, or Firm*—Fitzpatrick, Cella, Harper & Scinto

(57) ABSTRACT

This invention is intended to control the amount of power to be supplied to a fusing heater below a maximum applicable current value. The engine controller supplies electricity to both of two heating bodies at the same fixed duty D1. At a phase angle α1 corresponding to the fixed duty D1, pulse signals ON1 and ON2 are issued in response to a ZEROX signal as a trigger. A current value I1 is detected based on a HCRRT signal from the current detection circuit. The engine controller calculates an upper limit of applicable power duty Dlimit based on the detected current value I1, the fixed duty D1 and the preset applicable current value Ilimit. Then, a PI temperature control is performed at a duty below the upper limit duty Dlimit.

6 Claims, 26 Drawing Sheets

FOREIGN PATENT DOCUMENTS

| | | |
|---|---|---|
| JP | 4-44079 | 2/1992 |
| JP | 4-44080 | 2/1992 |
| JP | 4-44081 | 2/1992 |
| JP | 4-44082 | 2/1992 |
| JP | 4-44083 | 2/1992 |
| JP | 4-204980 | 7/1992 |
| JP | 4-204981 | 7/1992 |
| JP | 4-204982 | 7/1992 |
| JP | 4-204983 | 7/1992 |
| JP | 4-204984 | 7/1992 |
| JP | 4-335689 | 11/1992 |
| JP | 5-281864 | 10/1993 |
| JP | 6-131061 | 5/1994 |
| JP | 8-234621 | 9/1996 |
| JP | 2001-043964 | 2/2001 |
| JP | 2001-324892 | 11/2001 |
| JP | 2002-207391 | 7/2002 |
| JP | 2003-047252 | 2/2003 |
| JP | 2003-151720 | 5/2003 |

* cited by examiner

CROSS SECTION

HEATER PATTERN

IMAGE FUSING DEVICE AND IMAGE FORMING APPARATUS

This application claims priority from Japanese Patent Application Nos. 2003-012586 filed Jan. 21, 2003, 2003-098565 filed Apr. 1, 2003 and 2003-056997 filed Mar. 4, 2003, which are incorporated hereinto by reference.

BACKGROUND OF THE INVENTION

1. Field of the Invention

The present invention relates to an electrophotographic image forming apparatus and more specifically to a control of electric current supplied to a heater in a fusing device that heats and fixes a toner image carried on a recording medium.

2. Description of the Related Art

An image forming apparatus using an electrophotographic process has been known. In this image forming apparatus, an unfixed image (toner image) formed on a recording medium (print paper) by an image forming means such as the electrophotographic process is fixed on the paper by a fusing device. Among known fusing devices are a heat roller type fusing device using a halogen heater and a film heating type fusing device using a ceramic planar heater as a heat source, disclosed, for example, in Japanese Patent Application Laid-open Nos. 63-313182(1988), 2-157878 (1990), 4-44075(1992), 4-44076(1992), 4-44077(1992), 4-44078(1992), 4-44079(1992), 4-44080(1992), 4-44081 (1992), 4-44082(1992), 4-44083(1992), 4-204980(1992), 4-204981(1992), 4-204982(1992), 4-204983(1992) and 4-204984(1992).

Generally electric power is supplied from an ac power source through a switching device such as triac to these heaters.

In a fusing device using a halogen heater as a heat source, a temperature of the fusing device is detected by a temperature detecting element such as thermistor heat sensing element. Based on the detected temperature, an on/off operation of the switching element is controlled by a sequence controller, i e., the power supply to the halogen heater is on/off-controlled so that the temperature of the fusing device is kept at a target temperature.

In a fusing device using a ceramic planar heater as a heat source, the sequence controller determines a phase angle or wave number corresponding to a calculated power ratio supplied to the ceramic planar heater-according to a difference between the temperature detected by the temperature detecting element and the predetermined target temperature. Based on the phase or wave number thus determined, the switching element is on/off-controlled for the temperature control of the fusing device.

The fusing device of heat roller fixing type basically comprises a heat roller in the form of a heating roller (fixing roller) and an elastic pressure roller in the form of a pressing roller brought into pressure contact with the heat roller. In the heat roller fixing type fusing device, the pair of rollers are rotated to introduce between their pressure nip portions (fixing nip potions) a recording medium (such as image transfer sheet, electrostatic recording paper, electrofax paper and printing paper) which caries an unfixed image (toner image) to be fused, so that the recording medium is held under pressure between and fed by the two rollers. In this process, the heat roller type fusing device permanently fixes the unfixed image onto the recording medium (referred to as a transfer material) by the heat from the heat roller and the pressure of the pressure nip portions.

The film heating type fusing device (on-demand fusing device) is proposed, for example in Japanese Patent Application Laid-open Nos. 63-313182(1988), 2-157878(1990), 4-44075(1992) and 4-204980(1992). In these on-demand fixing devices, a heat resisting film (fixing film) as a heating roller is held against a heating body with a pressure roller (elastic roller) for sliding transport Next, a transfer material carrying an unfixed image is introduced, along with the heat resistant fixing film, into a pressure nip portion formed by the heating body and the pressure roller and fed through the nip portion. As a result, the unfixed toner image is fixed on the transfer material as a permanent image by the heat from the heating body and the pressure from the nip portion, applied through the heat resistant film.

The film heating type fusing device can use a linear heating body with a low heat capacity and a thin film with a low heat capacity. Therefore, this type of fusing device can reduce power consumption and wait time (quick start capability is assured). Further, the film heating type fusing device is known to drive the film by a drive roller provided on an inner side of the film or by a frictional force with the pressure roller used as the drive roller. However, in recent years the pressure roller drive method, which uses a smaller number of parts and is less expensive, is often used.

A known current detection circuit for detecting an electric current supplied to the heater of the fusing device is shown in FIG. 1 (Japanese Patent Application Laid-open No. 5-281864(1993)). This current detection circuit has a current transformer T1, a bridge diode D1, a capacitor C1, a resistor R1 and a voltmeter.

An ac power supply P1 is smoothed by a bridge diode D2 and a capacitor C2 and connected to a low voltage power supply. The current transformer T1 is connected to a line connected to the bridge diode D2 via a resistor R2.

When a current flows through the current transformer T1, a voltage of a proportional magnitude develops across a winding on a side opposite the power line (on a secondary side). The induced voltage is smoothed by the bridge diode D1 and the capacitor C1 and a terminal voltage of the resistor R1, i.e., a voltage proportional to the input current, is detected.

As to the control of a current supplied to the heater of the fusing device, however, there are the following problems.

A first problem is that the ac power to be supplied to the ceramic planar heater has a wide voltage range of, for example, 85V–140V or 187V–264V. Hence, the power supplied to the ceramic planar heater at a full duty has a wide variation such that the power supplied at the maximum voltage of the 85–140V voltage range is about 2.7 times that supplied at the minimum voltage of the same range. Also, the same supplied power has a wide variation such that the power supplied at the maximum voltage of the 187–264V voltage range is about 2 times that supplied at the minimum voltage of the same range.

Further, the current supplied to the ceramic planar heater is controlled by the sequence controller so that a predetermined temperature is kept. Thus, as the thickness of paper to be passed through the fusing device increases, the power or current that needs to be supplied increases. Depending on the kind of paper, more power than is necessary is supplied to the ceramic planar heater.

A second problem is that the fixing capability of a toner image on the transfer material in the fusing device is known to be influenced greatly by the thickness and surface roughness of the transfer material. Paper with a rough surface in particular has a significantly degraded fixing performance.

This is caused by the fact that a reduced contact area between the heating member and the paper in the nip portion results in a sufficient amount of heat failing to be supplied to the toner on the transfer material.

To obtain a good fixing performance even with a paper kind with rough surface, it is therefore necessary to increase the fixing pressure and the fixing temperature. However, increasing the fixing pressure tends to increase a drive torque of the fusing device and therefore the device cost. On the other hand, simply increasing the fixing temperature to obtain an improved fixing performance can result in an excessive amount of heat being supplied to thin paper and paper with good surface. This in turn causes problems such as hot offsets and increased curling of paper.

Optimum fixing requirements for both kinds of paper with rough surface and with smooth surface are difficult to satisfy and the conventional practice involves selecting an appropriate fixing temperature setting according to the kind of paper on the part of the user. However, setting the fixing mode using the surface roughness, a parameter that the user cannot easily understand, is not easy and there has been a call for a capability of automatically performing an appropriate fixing temperature setting according to the kind of paper.

A third problem is that since an output voltage of the current transformer T1 is full-wave rectified, it is very difficult to detect a current particularly when a phase control, which is often performed during a power control in an image forming apparatus, is executed.

Therefore, the control of current supplied to the heater in the fusing device may become inaccurate.

SUMMARY OF THE INVENTION

It is therefore an object of the present invention to provide an image forming apparatus that solves the aforementioned first problem and can control the amount of power to be supplied to a ceramic planar heater of a fusing device below a maximum applicable current value specified for the ceramic planar heater.

Another object of this invention is to meet the requirement of the second problem and make it possible to automatically set optimum fixing conditions (image heating conditions) irrespective of paper kind, particularly a surfaceness of a transfer material (print medium).

Still another object of this invention is to provide an image forming apparatus that can solve the aforementioned third problem and improve a detection accuracy of an input current to the fusing device.

In one aspect, this invention provides an image forming apparatus which comprises; a heating means for heating an image on a print medium or transfer material; a power supply means for supplying electricity to the heating means; an information detection means for detecting information on a thickness or surfaceness of the transfer material to be transported; and an adjust means for adjusting an electricity supplied to the power supply means according to the information detected by the information detection means.

In another aspect, this invention provides an electrophotographic image forming apparatus having a heating means and a power supply means for supplying electricity to the heating means, the electrophotographic image forming apparatus comprising: a first power control means for controlling the power supply means by a power ratio, a ratio of a desired power to a power obtained by fully turning on a half wave or full wave of an ac supply voltage, and for supplying power to the heating means for a predetermined duration at a predetermined first power ratio; a current detection means for detecting a current being supplied to the heating means by the first power control means; a calculation means for calculating a maximum applicable power ratio to be supplied to the heating means, based on a difference between a current value detected by the current detection means and a maximum applicable current value that can be supplied to the heating means by the power control means; and a second power control means for controlling the power to be supplied from the power supply means to the heating means at less than the maximum applicable power ratio calculated by the calculation means.

In still another aspect, this invention provides an image fusing device having a fixedly positioned heater, a film adapted to move in contact with the heater, and a pressure member cooperating with the heater, with the film interposed therebetween, to form a nip portion, wherein a transfer material carrying an image is passed between the film and the pressure member in the nip portion to heat the image on the transfer material with heat radiated from the heater through the film, the image fusing device comprising: a temperature detection means for detecting a temperature of the heater; a current detection means for detecting a current flowing in the heater; and a control means for controlling an electricity to the heater so that a current flowing in the heater is equal to a preset target current value and for correcting the preset target current value when the temperature detected by the temperature detection means as the transfer material passes through the nip portion deviates from a preset temperature range.

In a further aspect, this invention provides an image fusing device having a fixedly positioned heater, a film adapted to move in contact with the heater, and a pressure member cooperating with the heater, with the film interposed therebetween, to form a nip portion, wherein a transfer material carrying an image is passed between the film and the pressure member in the nip portion to heat the image on the transfer material with heat radiated from the heater through the film, the image fusing device comprising: a temperature detection means for detecting a temperature of the heater; a current detection means for detecting a current flowing in the heater; and a control means for controlling an electricity to the heater so that a temperature of the heater is equal to a preset target temperature and for correcting the preset target temperature when the current detected by the current detection means as the transfer material passes through the nip portion deviates from a preset range.

In a further aspect, this invention provides an image forming apparatus having a fusing device, comprising: a current-voltage conversion means for converting an input current to the fusing device into a voltage; a half-wave rectifying means for half-wave rectifying the voltage produced by the current-voltage conversion means; an integral means for integrating an half-wave rectified output produced by the half-wave rectifying means; a differential amplifying means for amplifying a difference between an integrated result produced by the integral means and the half-wave rectified output; a maximum value holding means for holding a maximum output from the differential amplifying means as a maximum value of the input current; a first pulse signal output means for outputting a pulse signal when an input supply voltage to the fusing device falls below a predetermined threshold; and a discharge means for discharging a capacitor forming the integral means and a capacitor forming the maximum value holding means in response to the pulse signal from the first pulse signal output means.

With the above construction, the present invention can set an upper limit on a maximum applicable power according to variations in an input supply voltage and a resistance of the heating means, which in turn enables a highest allowable power in a particular condition to be supplied to the heating means.

Further, with the image fusing device of this invention, it is possible to automatically set an optimum image fusing condition (fixing condition) independently of paper kind, particularly a surfaceness of a print medium or transfer material. This produces an effect of a reduced power consumption or energy saving.

Further, this invention can detect an input current with an improved accuracy and enhance a responsiveness, contributing to a finer or more precise control.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described in detail by referring to the accompanying drawings.

Embodiment 1-1

Figure 2:
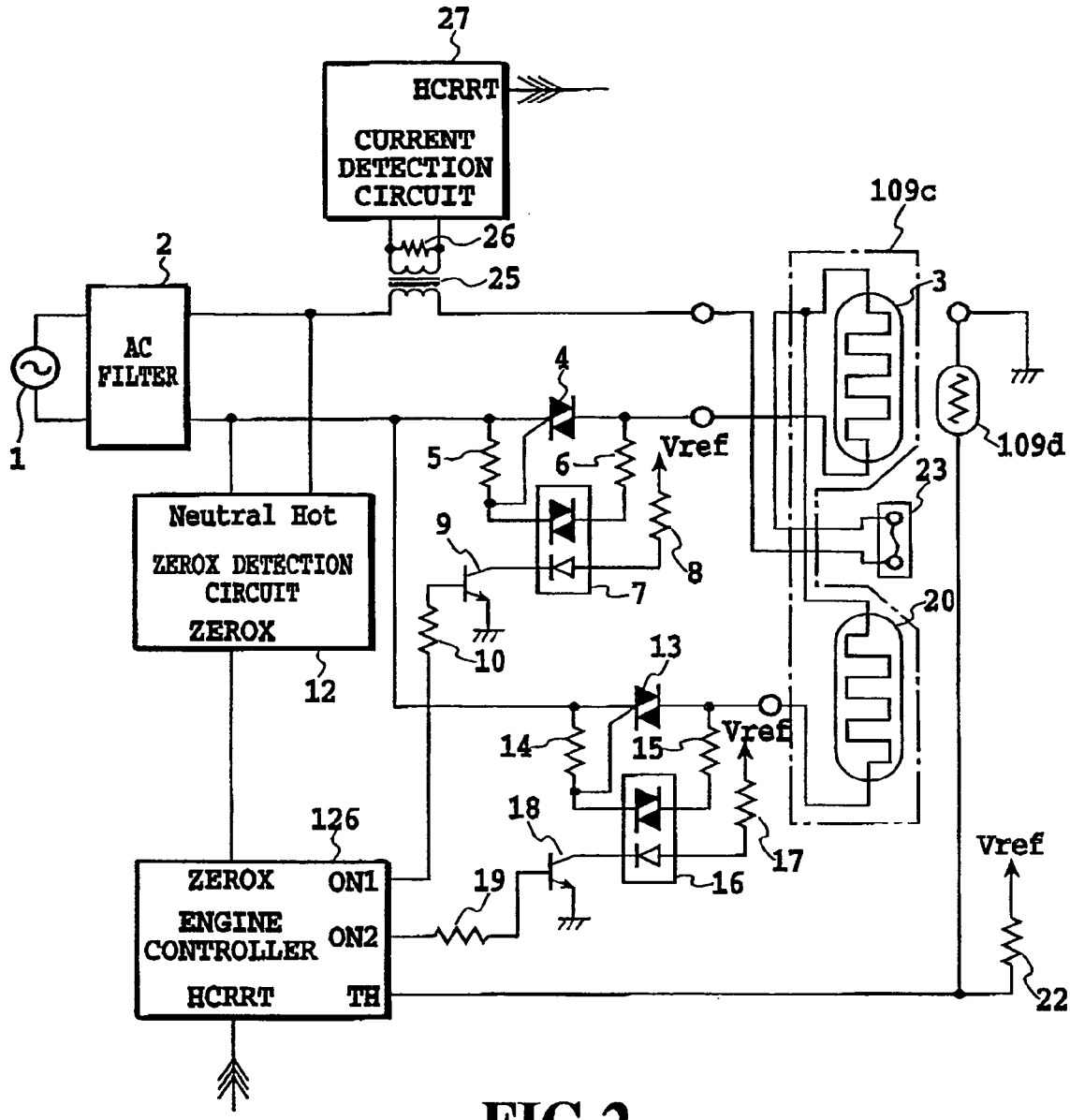
FIG. 2 is a block diagram of embodiment 1-1 of this invention.

FIG. 2 is a block diagram of embodiment 1-1 of this invention. This represents an example temperature control circuit to control a temperature of a ceramic planar heater as a heat source of the fusing device. A construction of a laser beam printer incorporating this temperature control circuit is shown in FIG. 3.

Figure 3:
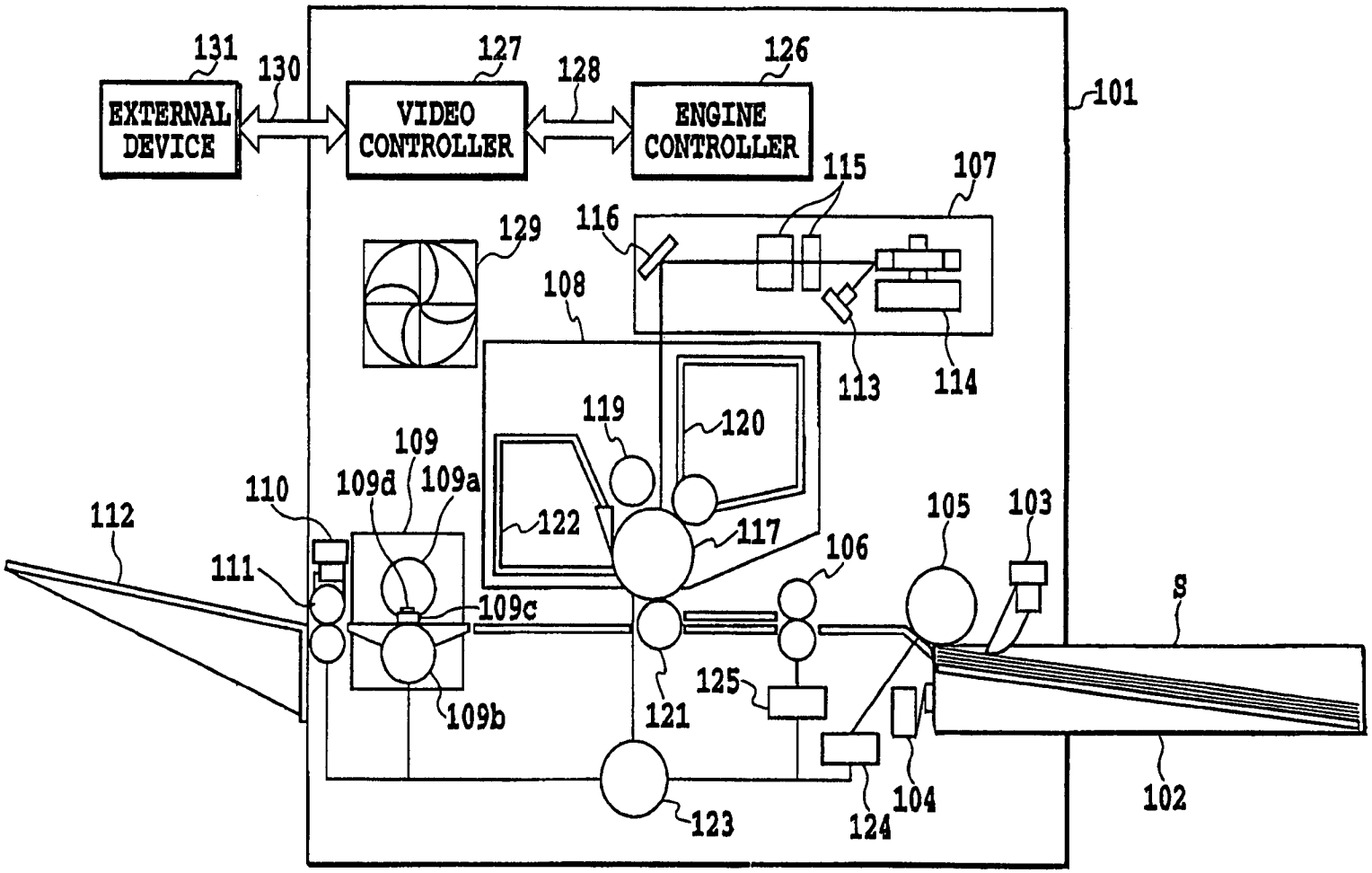
FIG. 3 is a cross-sectional view showing a construction of a laser beam printer as embodiment 1-1 of this invention.

FIG. 3 is explained in the following. A laser beam printer 101 has a cassette 102 accommodating print paper S, a cassette sensor 103 for detecting the presence or absence of print paper S in the cassette 102, a cassette size sensor 104 (made up of a plurality of microswitches) for detecting the size of the print paper S in the cassette 102, and a feed roller 105 for feeding print paper S from the cassette 102.

Arranged downstream of the feed roller 105 is a resist roller pair 106 for synchronously transporting the print paper S. Downstream of the resist roller pair 106 is installed an image forming unit 108 that forms a toner image on the print paper S according to laser light from a laser scanner unit 107. Downstream of the image forming unit 108 is installed a fusing device 109 that thermally fixes the toner image formed on the print paper S.

Arranged downstream of the fusing device 109 are a discharged paper sensor 110 for detecting the state of a paper discharge unit, discharge rollers 111 for discharging the printed paper S, and a tray 112 for stacking printed paper S thereon. A transport reference for the print paper S is set at a central portion of a width of the print paper, the width being taken to be a length of the paper in a direction perpendicular to the paper transport direction of the image forming unit.

The laser scanner unit 107 comprises a laser unit 113 that emits laser light modulated by an image signal (image signal VDO) issued from an external device 131 described later, and devices including a polygon motor 114, a focusing lens 115 and a reflection mirror 116 that combine to scan the laser light from the laser unit 113 over a photosensitive drum 117 described later.

The image forming unit 108 includes the photosensitive drum 117, a primary charge roller 119, a developer 120, a transfer charge roller 121, and a cleaner 122. The fusing device 109 comprises a fixing film 109*a*, an elastic pressure roller 109*b*, a ceramic planar heater 109*c* installed inside the fixing film, and a thermistor 109*d* for detecting a surface temperature of the ceramic planar heater 109*c*.

A main motor 123 drives the feed roller 105 through a feed roller clutch 124 and the resist roller pair 106 through a resist roller clutch 125. The main motor 123 also drives various devices in the image forming unit 108 including the photosensitive drum 117, and the fusing device 109 and the discharge rollers 111.

An engine controller 126 controls an electrophotographic process involving the laser scanner unit 107, image forming unit 108 and fusing device 109, and also performs a control to transport the print paper in the laser beam printer 101.

A video controller 127 is connected to the external device 131 such as a personal computer through a general purpose interface (Centronix, RS232C, etc.) 130. The video controller 127 transforms image information sent from the general purpose interface into bit data and sends them as a VDO signal to the engine controller 126.

Next, a temperature control circuit of FIG. 2 is explained. In FIG. 2, reference number 109*c*, 109*d* and 126 denote the corresponding parts in FIG. 3. Reference number 1 represents an ac power source for the laser beam printer. The ac power supply 1 is connected through an ac filter 2 to heating bodies 3, 20 that form the ceramic planar heater 109*c*. Power is supplied to the heating body 3 by turning a triac 4 on and off. A heating body 20 is energized or deenergized by turning a triac 13 on and off.

Denoted 5 and 6 are bias resistors for the triac 4, and 7 is a photo triac coupler to secure a creepage distance between the primary and secondary. The triac 4 is turned on by energizing a light emitting diode of the photo triac coupler 7. Designated 8 is a resistor to limit a current to the photo triac coupler 7. Reference number 9 denotes a transistor to on/off-control the photo triac coupler 7. The transistor 9 operates according to an ON1 signal supplied from the engine controller 126 through a resistor 10.

Denoted 14 and 15 are bias resistors for the triac 13, and 16 is a photo triac coupler to secure a creepage distance between the primary and secondary. The triac 13 is turned on by energizing a light emitting diode of the photo triac coupler 16. Designated 17 is a resistor to limit a current to the photo triac coupler 16. Reference 18 denotes a transistor to on/off-control the photo triac coupler 16. The transistor 18 operates according to an ON2 signal supplied from the engine controller 126 through a resistor 19.

Designated 12 is a zero-cross detection circuit connected to the ac power supply 1 through the ac filter 2. The zero-cross detection circuit 12 notifies to the engine controller 126 when the commercial supply voltage is below a predetermined threshold, by using a pulse signal (ZEROX signal). The engine controller 126 detects a pulse edge of ZEROX signal and performs an on/off control on the triac 4 or 13 by a phase or frequency control.

A heater current controlled by the triacs 4 and 13 and supplied to the heating bodies 3, 20 is transformed into a voltage by the current transformer 25 and input to a current detection circuit 27 through a resistor 26. The current detection circuit 27 transforms the voltage-converted heater current waveform into an average value or effective value, performs an A/D conversion on the averaged voltage and supplies it as HCRRT signal to the engine controller 126.

Denoted 109*d* is a thermistor for detecting a temperature of the ceramic planar heater 109*c* made up of the heating bodies 3, 20. The thermistor 109*d* is placed on the ceramic planar heater 109*c* through an insulating material with a dielectric breakdown voltage high enough to secure a creepage distance from the heating bodies 3, 20. The temperature detected by the thermistor 109*d* is detected as a voltage divided between a resistor 22 and the thermistor 109*d* and then A/D-input to the engine controller 126 as a TH signal. The temperature of the ceramic planar heater 109*c* is monitored as the TH signal by the engine controller 126. The temperature of the ceramic planar heater 109*c* is compared with a target temperature for the ceramic planar heater 109*c* set internally in the engine controller 126. The engine controller 126 then calculates a power ratio to be supplied to the heating bodies 3, 20 forming the ceramic planar heater 109*c* and converts the calculated power ratio into a phase angle (phase control) or wave number (wave number control). According to the conditions of these controls, the engine controller 126 sends an ON1 signal to the transistor 9 or an ON2 signal to the transistor 18. In calculating the power ratio to be supplied to the heating bodies 3, 20, the engine controller 126 calculates an upper limit power ratio based on a HCRRT signal from the current detection circuit and performs a control so that a power below the upper limit power ratio is supplied. In the case of the phase control, for instance, the engine controller 126 has a control table, such as Table 1 below, and performs control according to this table.

TABLE 1

| Power ratio Duty D (%) | Phase angle α(°) |
|---|---|
| 100 | 0 |
| 97.5 | 28.56 |
| . | . |
| . | . |
| . | . |
| 75 | 66.17 |
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

Further, a thermostat 23 is placed on the ceramic planar heater 109*c* to prevent the temperature of the energized heating bodies 3, 20 from rising excessively in the event that a control means to control the power supply to the heating bodies 3, 20 should fail leaving the heating bodies 3, 20 to thermally run away. When a failure of the power supply control means results in the heating bodies 3, 20 thermally running away and the thermostat 23 exceeds a predetermined temperature, the thermostat 23 opens interrupting the current flow to the heating bodies 3, 20.

Figure 1:
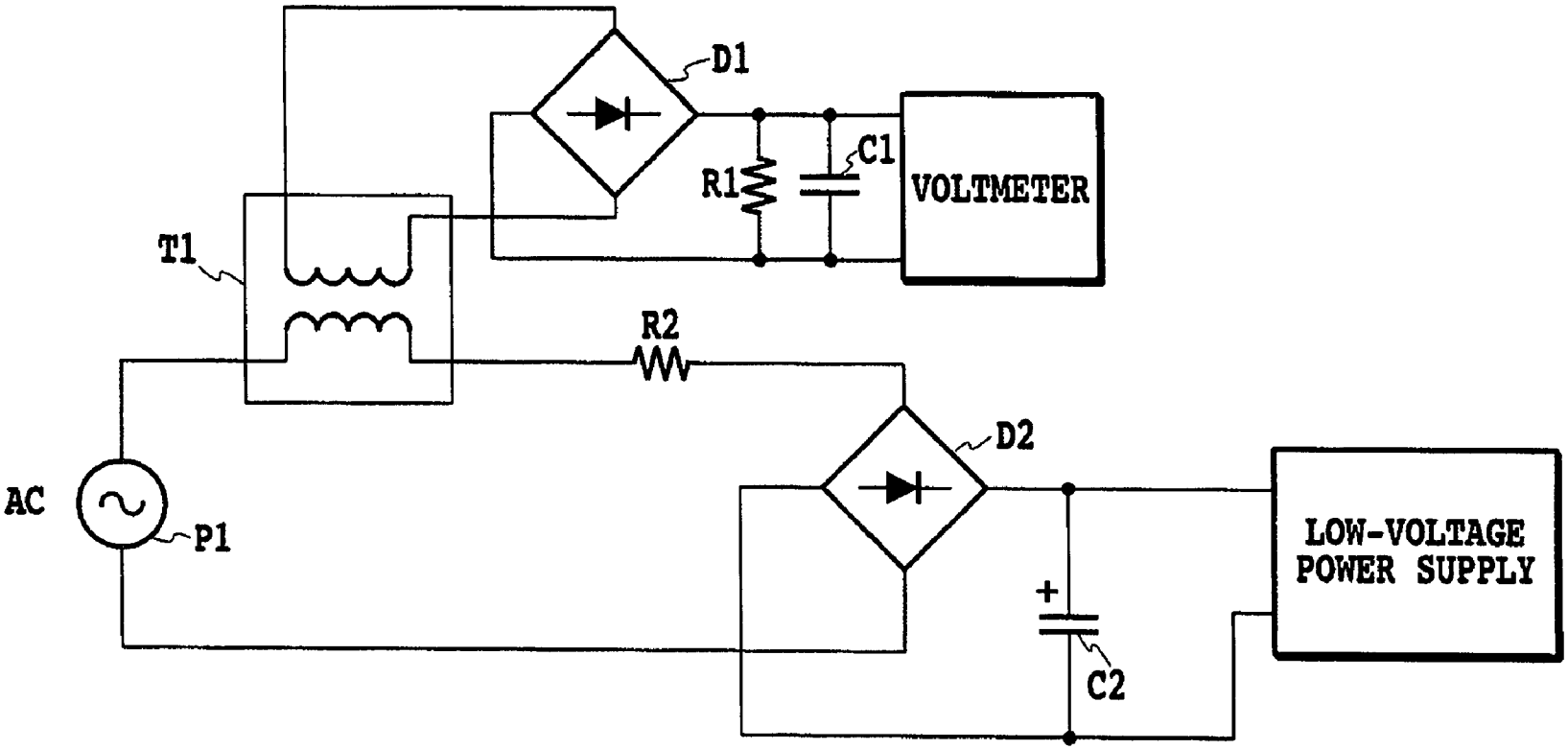
FIG.1 PRIOR ART
FIG. 1 is a circuit diagram showing a conventional current detection circuit.
Figure 4A:
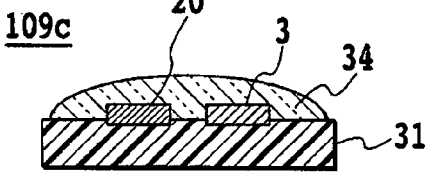
FIGS. 4A and 4B illustrate a construction of a ceramic planar heater 109*c* of FIG. 1 in embodiment 1-1 of this invention.
Figure 4B:
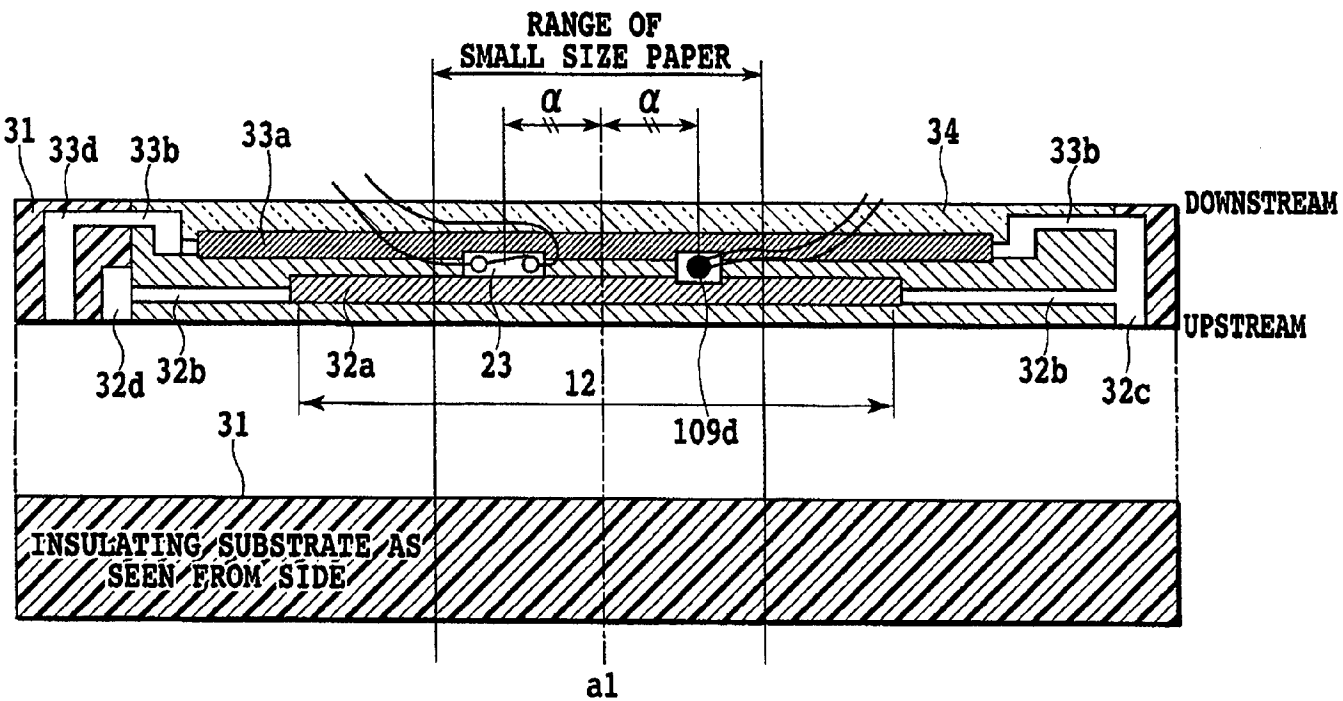

FIGS. 4A and 4B show a construction of the ceramic planar heater 109*c* of FIG. 1. FIG. 4A represents a transverse cross section of the ceramic planar heater 109*c* and FIG. 4B illustrates a heating body pattern and a nip side surface In FIGS. 4A and 4B reference numbers 3, 20 and 23 represent the portions of the same reference numbers in FIG. 2.

The ceramic planar heater 109*c* comprises a ceramic insulating substrate 31 of ceramics such as SiC. AlN and $Al_2O_3$, heating bodies 3, 20 formed on the insulating substrate 31 as by paste printing, and a protective layer 34 such as glass protecting the two heating bodies. The thermistor 109*d* and the thermostat 23 that detect the temperature of the ceramic planar heater 109*c* are arranged on the protective layer 34. The positions are generally laterally symmetric with respect to the print paper transport reference a1 (a longitudinal center of heating portions 32*a*, 33*a*) and which are located inside the width of a smallest size of paper that can be passed through the fusing device.

The heating body 3 has a heating portion 32*a* that heats when supplied electricity, conductive portions 32*b* for connecting electrode portions 32*c*, 32*d* to the heating body 3, and electrode portions 32*c*, 32*d* that are supplied electricity through connectors. The heating body 20 has a heating portion 33*a* that heats upon being supplied electricity, conductive portions 33*b* for connecting electrode portions 32*c*, 33*d* to the heating body 20, and electrode portions 32*c*, 33*d* that are supplied electricity through connectors. The electrode portion 32*c* is connected to two heating bodies 3, 20 and functions as their common electrode. For an improved slidability, a glass layer may be formed on a surface of the insulating substrate 31 opposite the surface where the heating bodies 3, 20 are printed.

The electrode portion 32*c* is connected with a hot side terminal of the ac power supply 1 through the thermostat 23. The electrode portion 32*d* is connected to the triac 4 that controls the heating body 3 and also to a neutral terminal of the ac power supply 1. The electrode portion 33*d* is electrically connected to the triac 13 that controls the heating body 20 and to the neutral terminal of the ac power supply 1.

Figure 5B:
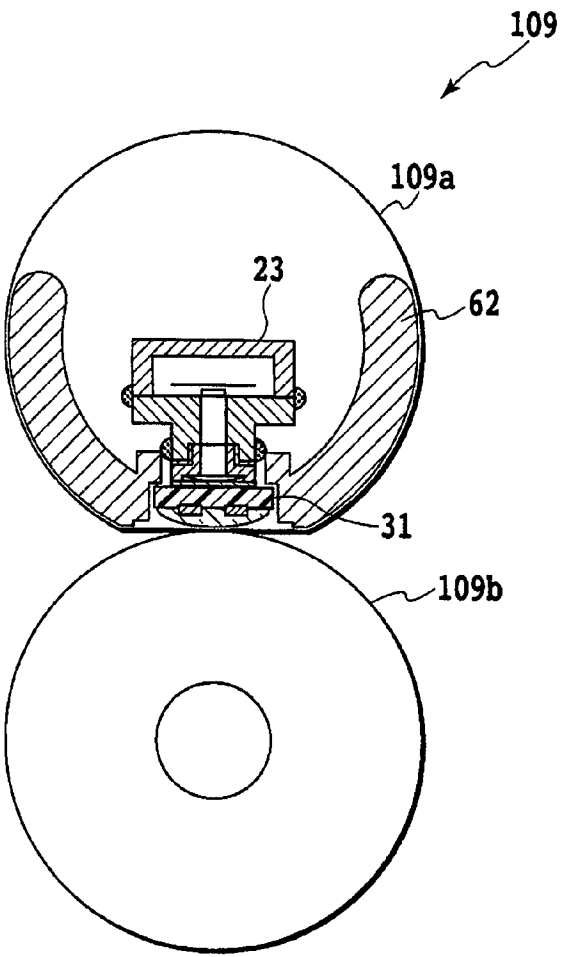
FIGS. 5A and 5B are cross-sectional views showing a construction of a fusing device 109 in embodiment 1-1 of this invention.
Figure 5A:
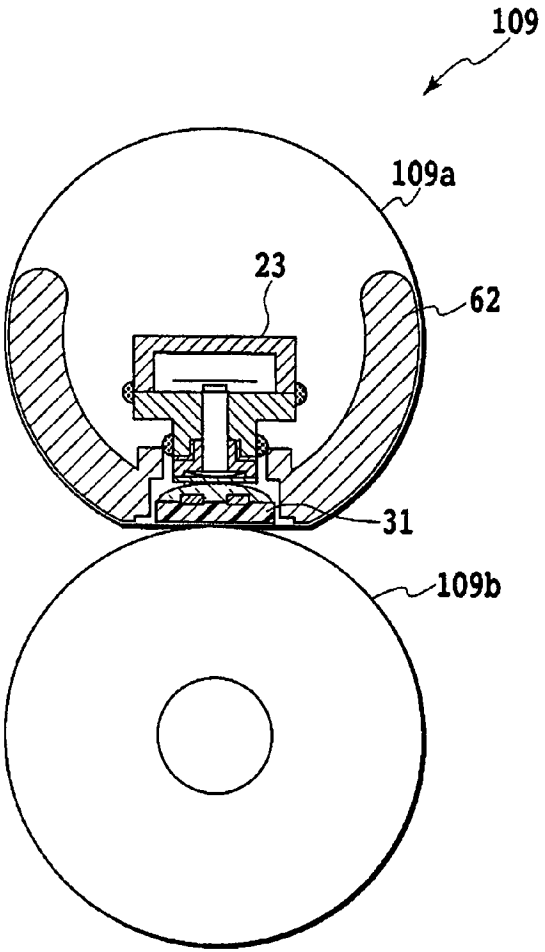

The ceramic planar heater 109*c* is supported by a film guide 62, as shown in FIGS. 5A and 5B. Denoted 109*a* is a cylindrical fixing film of a heat resistant material sleeved over the film guide 62, which supports the ceramic planar heater 109*c* on the bottom surface side thereof. The ceramic planar heater 109*c* at the bottom of the film guide 62 and the elastic pressure roller 109*b* as a pressing member are elastically pressed against each other under a predetermined pressure to form a nip portion of a predetermined width as a heating portion, with the fixing film 109*a* held between them. The thermostat 23 is placed in contact with a surface of the insulating substrate 31 or the protective layer 34 of the ceramic planar heater 109*c*. The thermostat 23 has its position corrected by the film guide 62 so that its heat sensing surface is in contact with the surface of the ceramic planar heater 109*c*. Though not shown, the thermistor 109*d* is also put in contact with the surface of the ceramic planar heater 109*c*. The ceramic planar heater 109*c*, as shown in FIGS. 5A and 5B, may be arranged such that the heating bodies 3, 20 are on a side opposite the nip portion or on the nip portion side. To enhance the slidability of the fixing film 109*a*, grease may be applied to boundary surfaces of the fixing film 109*a* and the ceramic planar heater 109*c*.

Figure 6:
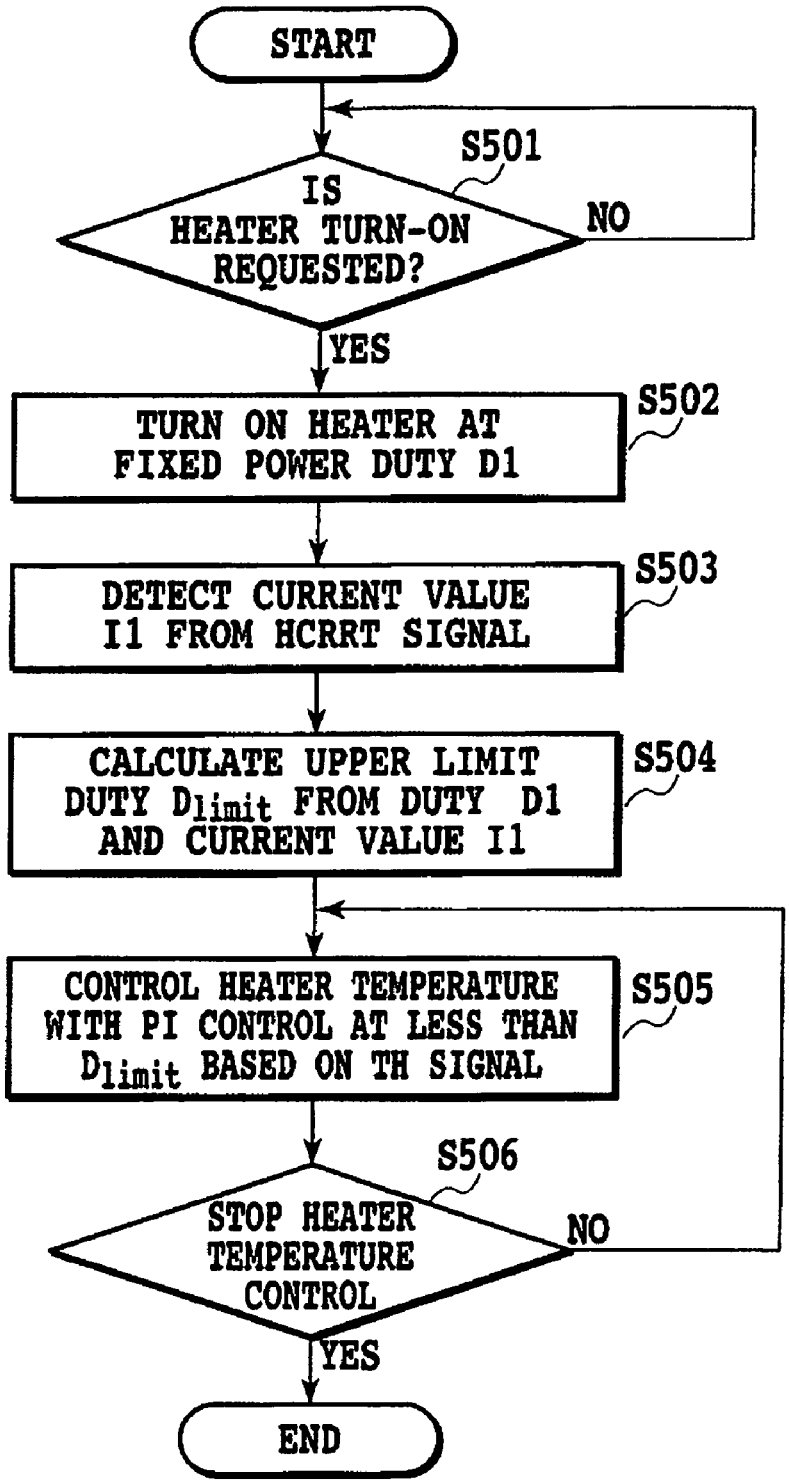
FIG. 6 is a flow chart showing an example control sequence for the fusing device 109 in embodiment 1-1 of this invention.
Figure 7:
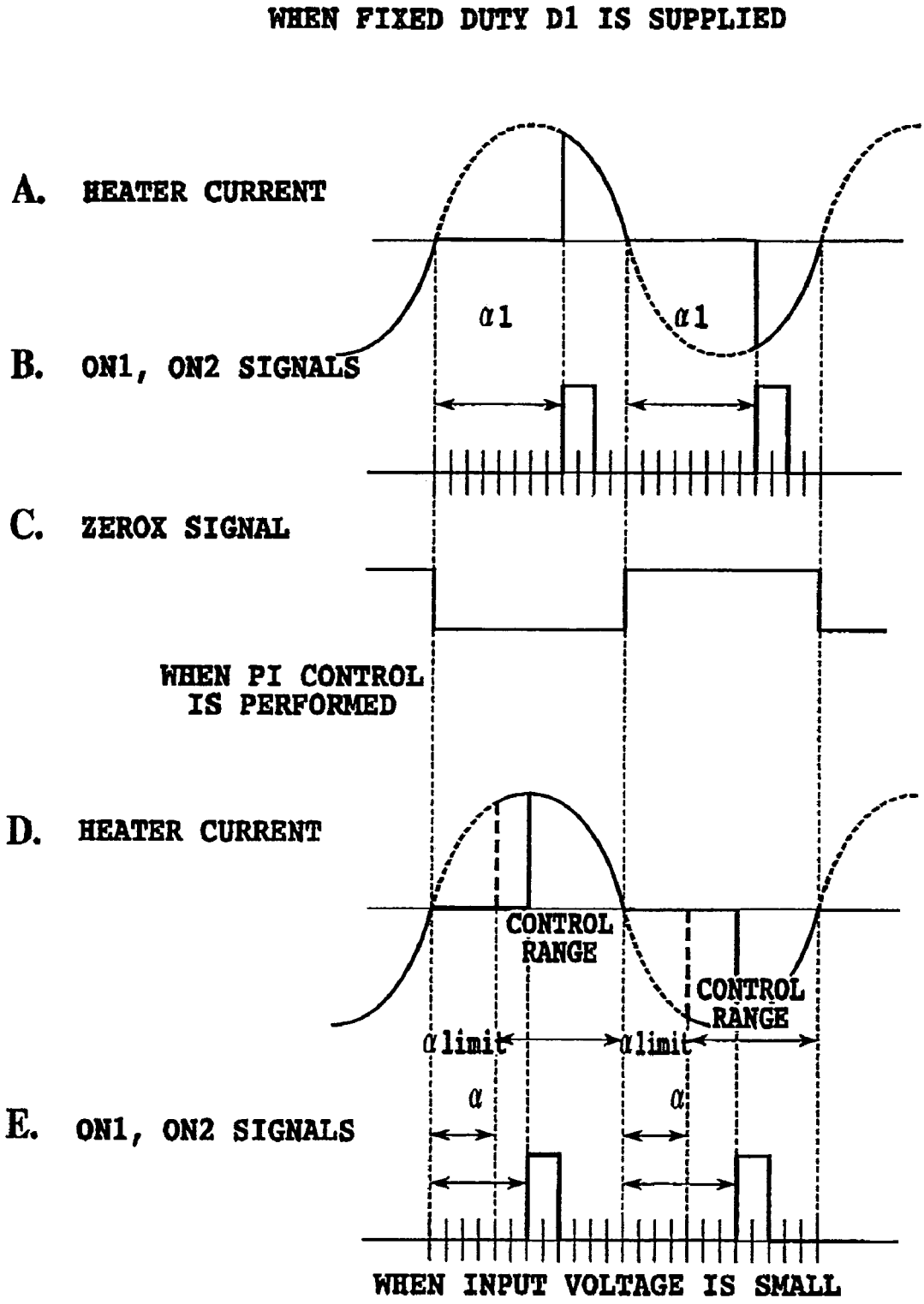
FIG. 7 is waveform diagrams showing rough operation waveforms of heater current and ON1 and ON2 signals when an input voltage in embodiment 1-1 of this invention is small.
Figure 8:
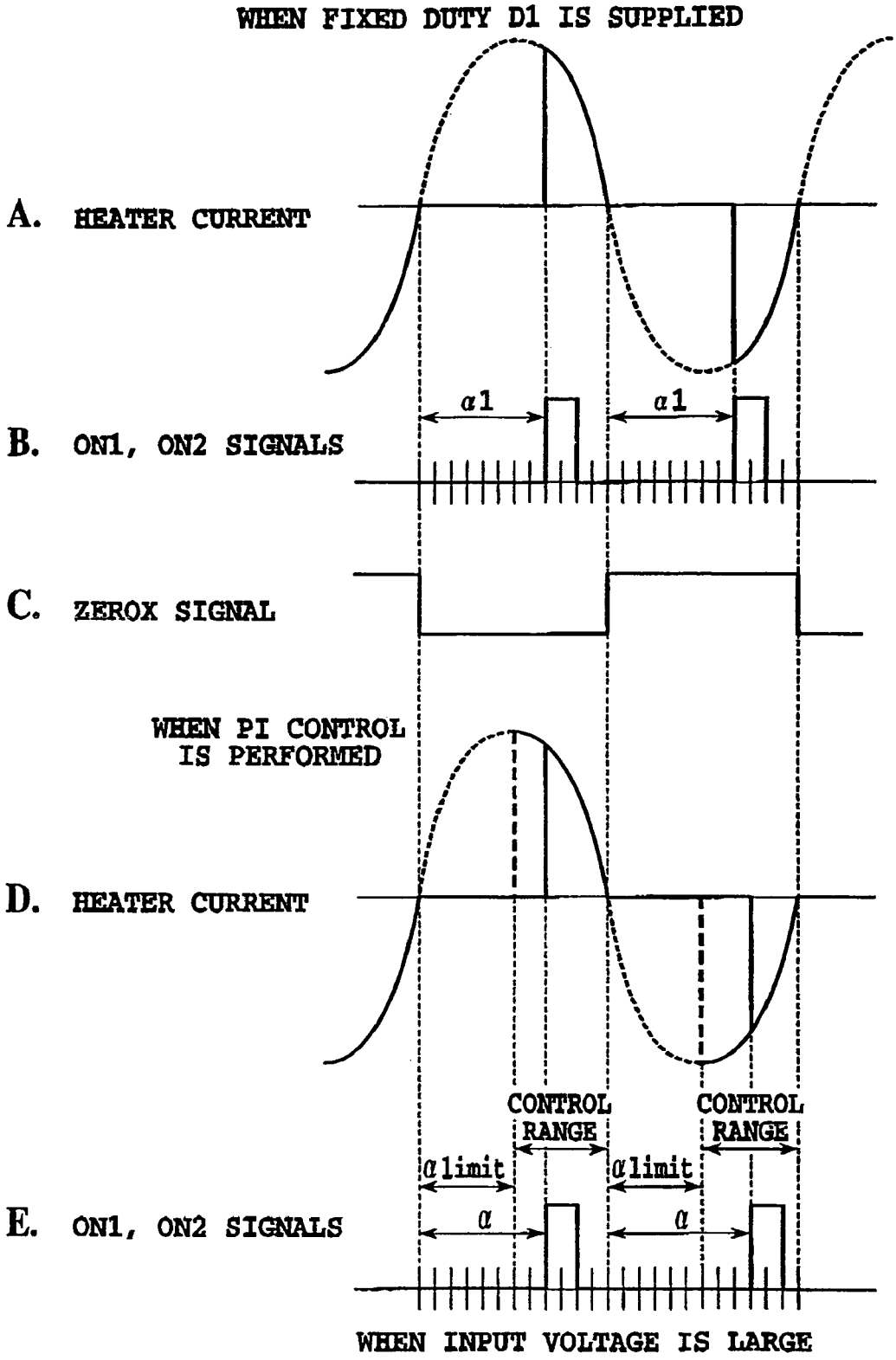
FIG. 8 is waveform diagrams showing rough operation waveforms of heater current and ON1 and ON2 signals when an input voltage in embodiment 1-1 of this invention is large.

FIG. 6 is a flow chart showing an example control sequence for the fusing device 109. A to E of FIG. 7 and A to E of FIG. 8 illustrate schematic operation waveforms of a heater current and ON1 and ON2 signals. A to E of FIG. 7 show operation waveforms when an input voltage is low within a predetermined voltage range. A to E of FIG. 8 show operation waveforms when the input voltage is high. In the following description we refer only to the operation waveforms of A to E of FIG. 7.

When a request to start power supply to the ceramic planar heater 109*c* occurs (step S501), the engine controller 126 energizes the heating bodies 3, 20 with the same, fixed duty D1 (S502). At a phase angle α1 corresponding to the fixed duty D1, ON-pulses of ON1 and ON2 signals with a ZEROX signal as a trigger are issued from the engine controller 126 (see B and C of FIG. 7). The ceramic planar heater 109*c* is supplied an electric current at the phase angle α1 (A of FIG. 7).

A current value I1 is detected based on a HCRRT signal sent from the current detection circuit 27 when the heating bodies are energized with the fixed duty D1 (S503). The fixed duty D1 is set to a value not exceeding an allowable current, considering a probable input voltage range and heating body resistance. That is, the fixed duty D1 is set on the assumption that the input voltage is maximum and the resistance is minimum. From the detected current value I1, the fixed duty D1 and a preset maximum applicable current value Ilimit, the engine controller 126 calculates an upper limit power duty Dlimit that can be applied to the heating bodies (S504). If the current value that-the current detection circuit 27 informs to the engine controller 126 is an effective value, the Dlimit is determined from the following equation.

$$D\text{limit}=(I\text{limit}/I1)^2\times D1$$

The current value Ilimit is assigned an allowable current value applicable to the ceramic planar heater 109*c* which is a current to other than the ceramic planar heater 109*c* subtracted from the rated current of the connected commercial power supply.

The engine controller 126 controls power supplied to the heating bodies 3, 20 by a PI control based on the information from a TH signal so that the heating bodies are kept at a predetermined temperature. The power supply duty is determined from a difference between the target temperature and the temperature based on the TH signal. If the calculated duty should exceed the upper limit duty Dlimit, a power ratio of the upper limit duty Dlimit is supplied. That is, the PI temperature control is performed at a duty less than the upper limit duty Dlimit (S505). ON1 and ON2 signal waveforms and a heater current waveform in this situation are shown in E of FIG. 7 and D of FIG. 7 respectively. It is seen that the phase control is performed at a phase angle greater than a phase angle αlimit corresponding to Dlimit. The Dlimit (αlimit) varies depending on the magnitude of the input voltage, allowing the current to be controlled below the Ilimit at all times regardless of the input voltage.

Until a heater temperature control stop request is received, the control continues to be performed at less than the calculated upper duty Dlimit (S506).

As described above, at the start of the operation of the fusing device 109 this embodiment supplies power of a predetermined ratio, calculates an upper limit of the power ratio to be supplied and performs a power control at a smaller ratio. This prevents a current in excess of the allowable value from being supplied as it would be if the temperature of the ceramic planar heater 109*c* drops suddenly during the temperature control as when an unexpectedly thick or heavy paper is passed.

Further, an upper limit can be set on the applicable power according to variations in the input supply voltage and heater resistance. The heating bodies therefore can produce a maximum power performance under a variety of conditions.

If only one heating body is used, the similar control is possible.

Embodiment 1-2

Figure 9:
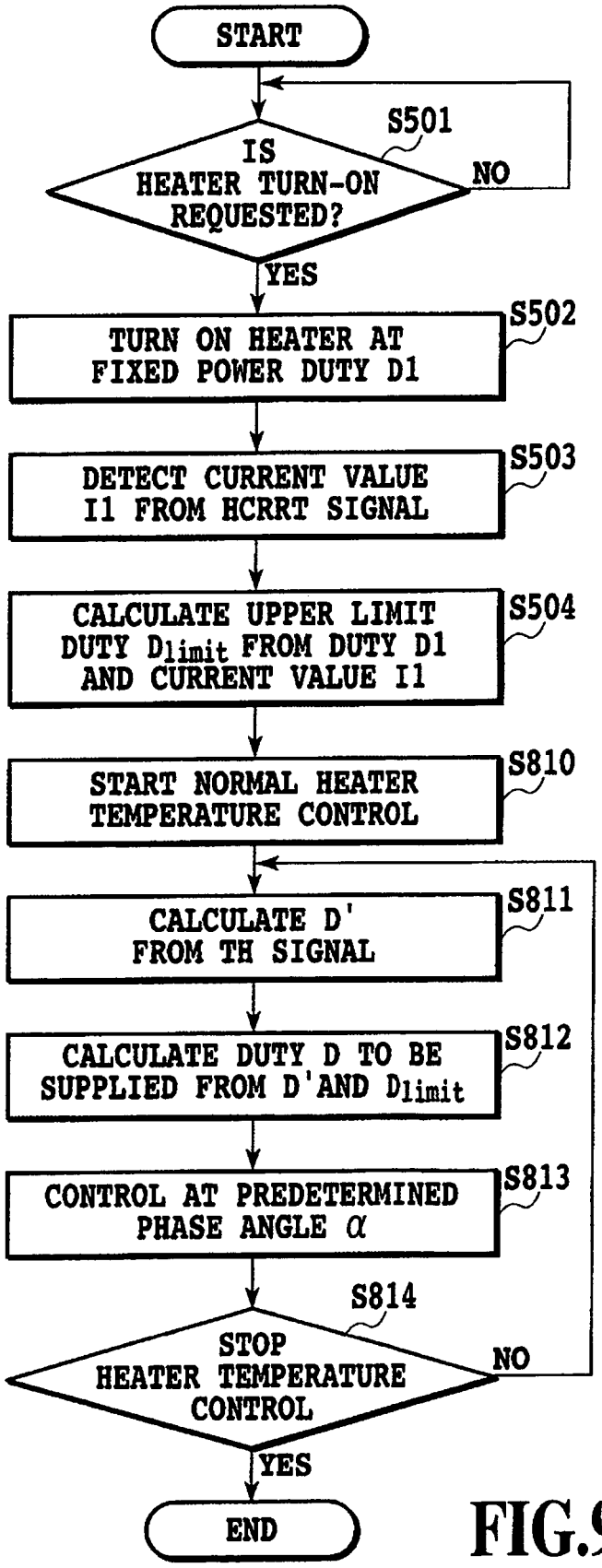
FIG. 9 is a flow chart showing an example control sequence for the fusing device 109 in embodiment 1-2 of this invention.
Figure 10:
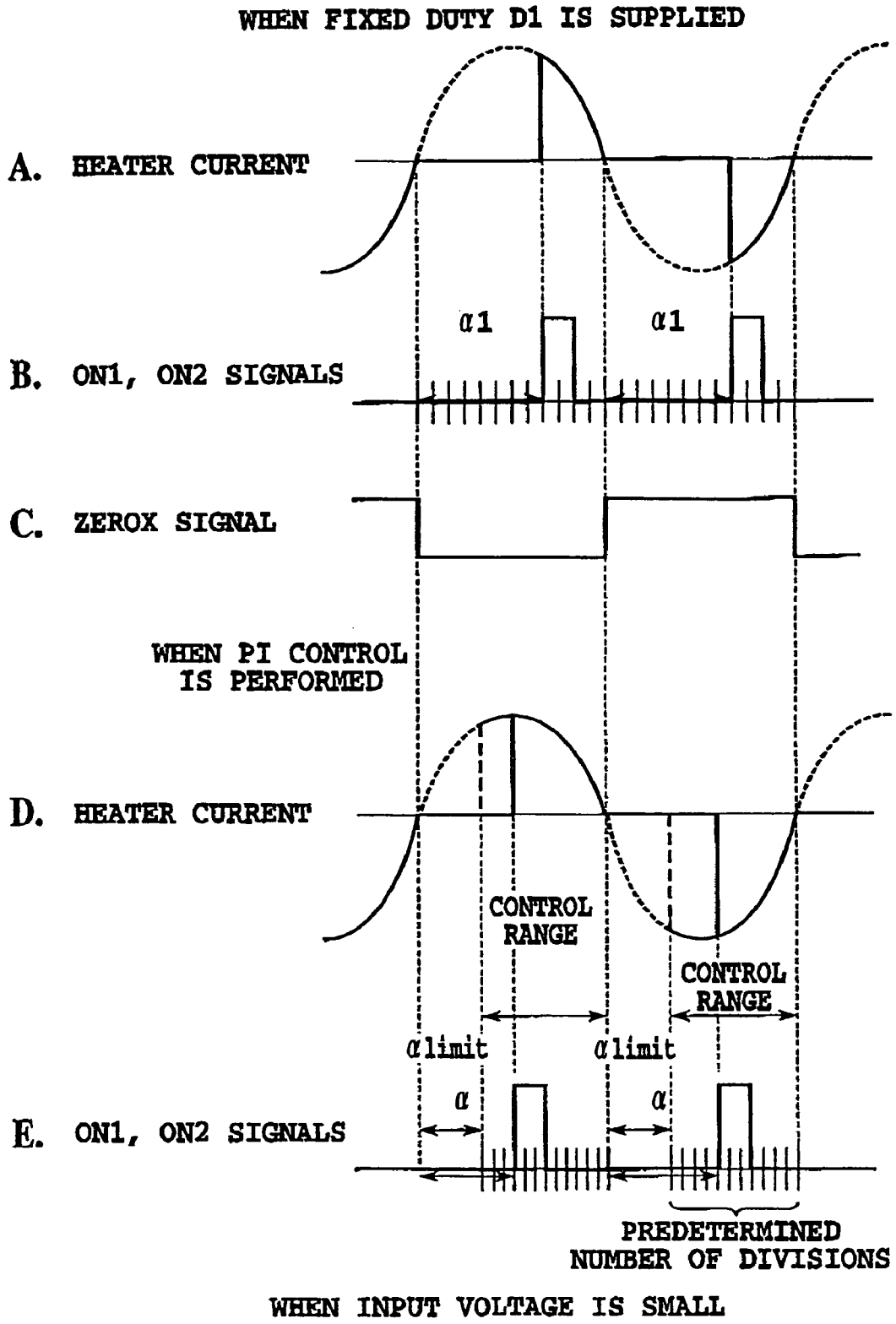
FIG. 10 is waveform diagrams showing rough operation waveforms of heater current and ON1 and ON2 signals when an input voltage in embodiment 1-2 of this invention is small.
Figure 11:
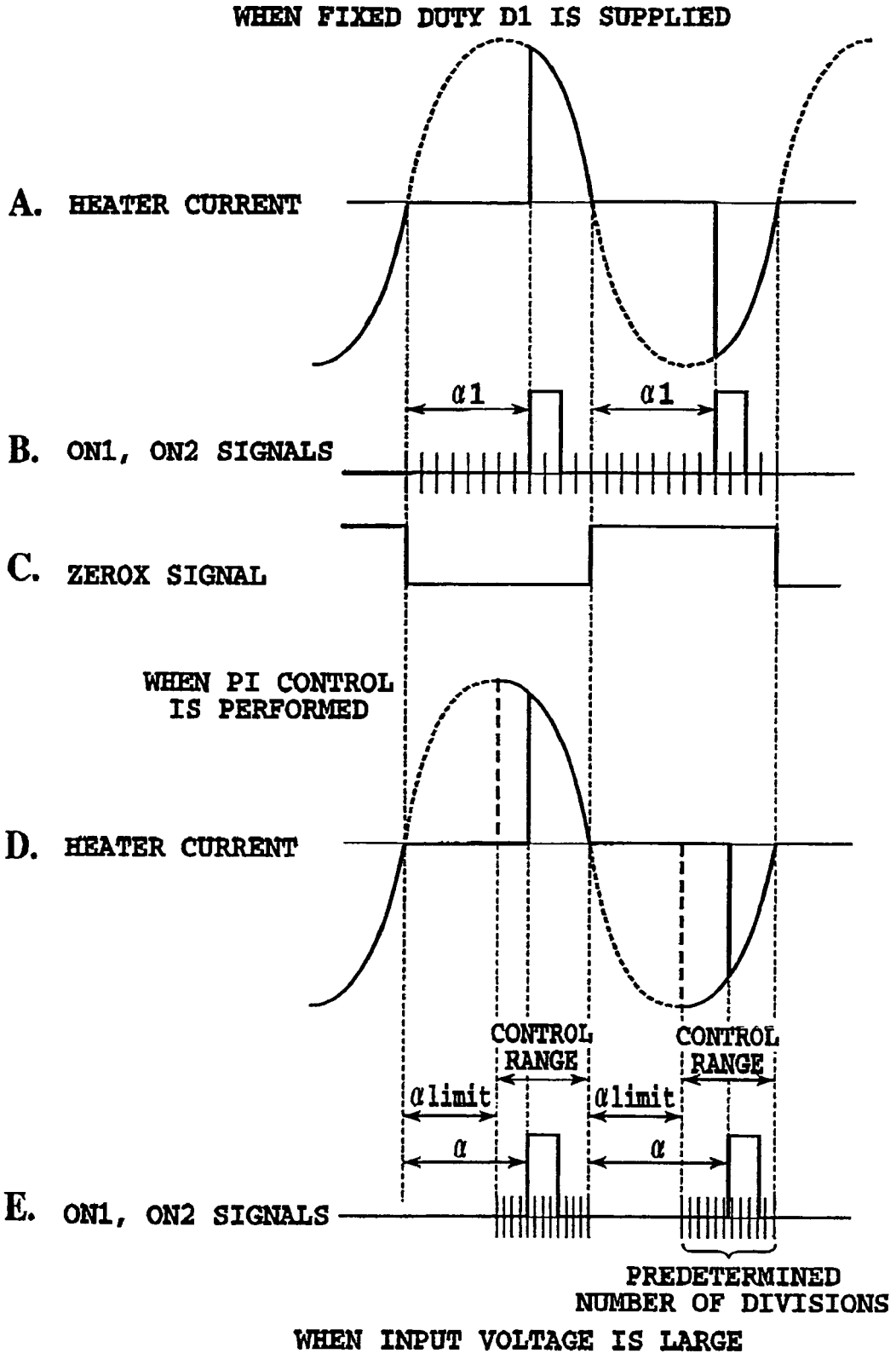
FIG. 11 is waveform diagrams showing rough operation waveforms of heater current and ON1 and ON2 signals when an input voltage in embodiment 1-2 of this invention is large.

FIG. 9 is a flow chart showing an outline of a control sequence for the fusing device in this embodiment. In FIG. 9 steps S501 to S504 are the same as in FIG. 6 A to E of FIG. 10 and A to E of FIG. 11 illustrate schematic operation waveforms of a heater current and ON1 and ON2 signals. A to E of FIG. 10 represent operation waveforms when an input voltage is low within the predetermined voltage range. A to E of FIG. 11 represent operation waveforms when the input voltage is high. In the following description, we will refer only to the operation waveforms of A to E of FIG. 10.

When a request to start power supply to the ceramic planar heater 109*c* occurs (step S501), the engine controller 126 energizes the heating bodies 3, 20 with the same, fixed duty D1 (S502). At a phase angle α1 corresponding to the fixed duty D1, ON-pulses of ON1 and ON2 signals with a ZEROX signal as a trigger are issued from the engine controller 126 (see B and C of FIG. 10). The ceramic planar heater 109*c* is supplied an electric current at the phase angle α1 (A of FIG. 10). A current value I1 is detected based on a HCRRT signal sent from the current detection circuit 27 when the heating bodies are energized with the fixed duty D1 S503). The fixed duty D1 is set to a value not exceeding an allowable current, considering a probable input voltage range and heating body resistance. That is, the fixed duty D1 is set by assuming a case where the input voltage is maximum and the resistance is minimum. From the detected current value I1, the fixed duty D1 and a preset maximum applicable current value Ilimit, the engine controller 126 calculates an upper limit power duty Dlimit that can be applied to the heating bodies (S504). If the current value that the current detection circuit 27 informs to the engine controller 126 is an effective value, the Dlimit is determined from the following equation.

$$D\text{limit}=(I\text{limit}/I1)^2\times D1$$

The current value Ilimit is assigned an allowable current value applicable to the ceramic planar heater 109*c* which is a current to other than the ceramic planar heater 109*c* subtracted from the rated current of the connected commercial power supply.

Once the Dlimit is determined, the normal fusing device temperature control is started (S810). When, for example, power applied to the heating bodies is phase-controlled, the control is performed according to the following relation between the power duty D(%) and the phase angle α(°).

$$\left.\begin{array}{ll} D > 97.5 & \alpha = -8\times(D-100) \\ 97.5 \geq D \geq 2.5 & \alpha = -10/9\times(D-95)+40 \\ D < 2.5 & \alpha = -8\times(D-5)+140 \end{array}\right\} \quad (1)$$

The engine controller 126 controls power supplied to the heating bodies 3, 20 by a PI control based on the information from a TH signal so that the heating bodies are kept at a predetermined temperature (S811). The power supply duty D' is determined from a difference between the target temperature and the temperature based on the TH signal. For example, the duty is determined from an equation below.

$$\begin{aligned} D' &= Dp(Pcontrol) + Di(Icontrol) \\ &= 2.5\%(targettemperature - detectedtemperature + 2.5\%(A/T)\times \\ &\quad \sum_{i=0}^{T}(targettemperature - detectedtemperature) \end{aligned} \quad (2)$$

Equation (2) shows that the duty D' thus determined takes one of 40 values into which the range of between 0% and 100% is divided (at 2.5% intervals) depending on the temperature difference condition. From the calculated duty D' and the previously calculated Dlimit, the duty D to be supplied is determined from equation (3) below (S812).

$$D=D'\times D\text{limit}/100 \quad (3)$$

Substituting the calculated duty D into equation (1) determines the phase angle α at which to turn on the triac 4 or 13. Using this phase angle, the phase control is executed (S813). That is, the PI temperature control can be performed below the upper limit duty Dlimit always at 40-division intervals. The heater current waveform and the ON1 and ON2 signal waveforms during this control are shown in D and E of FIG. 10 respectively. The phase control is performed at an angle larger than the phase angle αlimit corresponding to Dlimit.

Further, the Dlimit (αlimit) varies depending on the magnitude of the input voltage, allowing the current to be controlled below the Ilimit at all times regardless of the input voltage. The number of divisions that the power duty is divided into during the phase control is always 40. Thus, when the input voltage is small, the phase angle for a single division of duty becomes large in comparison. When the input voltage is large, the phase angle for one duty division becomes relatively small.

If the Ilimit is to be limited at a desired duty, the control is performed by using a power duty which is obtained by dividing a power equal to (heating body resistance) X $\text{Ilimit}^2$ by the predetermined division number. Therefore, a control can be made in which power corresponding to one division remains almost constant if the supply voltage changes.

Until a heater temperature control stop request is received, the control continues to be performed at less than the calculated upper duty Dlimit (S814).

As described above, at the start of the operation of the fusing device this embodiment supplies power of a predetermined ratio, calculates an upper limit of the power ratio to be supplied and performs a power control at a smaller ratio using the same number of divisions whatever the upper limit value. This prevents a current in excess of the allowable value from being supplied as it would be if the heater temperature drops suddenly during the temperature control as when an unexpectedly thick or heavy paper is passed.

Further, an upper limit can be set on the applicable power according to variations in the input supply voltage and heater resistance. It is also possible to limit the power of a unit ratio to less than a value of (allowable power/number of divisions). As a result, temperature ripples are optimized under a variety of conditions, maximizing a power performance of the heater bodies.

If only one heating body is used, the similar control is possible.

General Description of Embodiments 1-1, 1-2

Embodiments 1-1, 1-2 of this invention are summarized as follows.

[Description 1-1]

An electrophotographic image forming apparatus having a heating means and a power supply means for supplying electricity to the heating means is characterized by:

a first power control means for controlling the power supply means with a power ratio, a ratio of a supplied power to a power obtained by fully turning on a half wave or full wave of an ac supply voltage, to supply power to the heating means at a predetermined first power ratio for a predetermined duration;

a current detection means for detecting a current supplied from the first power control means to the heating means;

a calculation means for calculating a maximum power ratio that can be supplied to the heating means, based on a difference between a current value detected by the current detection means and a maximum current value that can be supplied to the heating means from the power control means; and a second power control means for controlling the power supplied from the power supply means to the heating means below the maximum applicable power ratio calculated by the calculation means.

[Description 1-2]

An electrophotographic image forming apparatus according to description 1-1 is characterized by:

a temperature detection means for detecting a temperature of the heating means power-controlled by the second power control means;

a decision means for comparing the temperature detected by the temperature detection means and a predetermined target temperature, calculating a second power ratio to be supplied to the heating means, and determining a phase angle corresponding to the second power ratio; and a phase control means for phase-controlling the power to be supplied to the heating means based on the phase angle determined by the decision means.

[Description 1-3]

An electrophotographic image forming apparatus according to description 1-1 or 1-2 is characterized in that the second power control means controls power to be supplied to the heating means by taking the maximum applicable power ratio calculated by the calculation means as a 100% power ratio, dividing the maximum applicable power ratio by a predetermined division number, and controlling the power to be supplied to the heating means with a power ratio having a predetermined number of divisions.

[Description 1-4]

An electrophotographic image forming apparatus according to any of descriptions 1-1 to 1-2 is characterized in that the heating means has an insulating substrate and one or more heating bodies formed on one or both surfaces of the insulating substrate.

[Description 1-5]

An electrophotographic image forming apparatus according to any of descriptions 1-1 to 1-3 is characterized by a fusing device which has a film in sliding contact with the heating means of embodiment 1-4 and a rotatable pressing body pressed against the heating means, with the film interposed therebetween, to form a nip portion, wherein the fusing device performs a fixing process on a printed medium carrying an unfixed image by heating the printed medium with heat of the heating bodies as it is passed through nip portion.

Embodiment 2-1

(1) Example of Image Forming Apparatus

Figure 12:
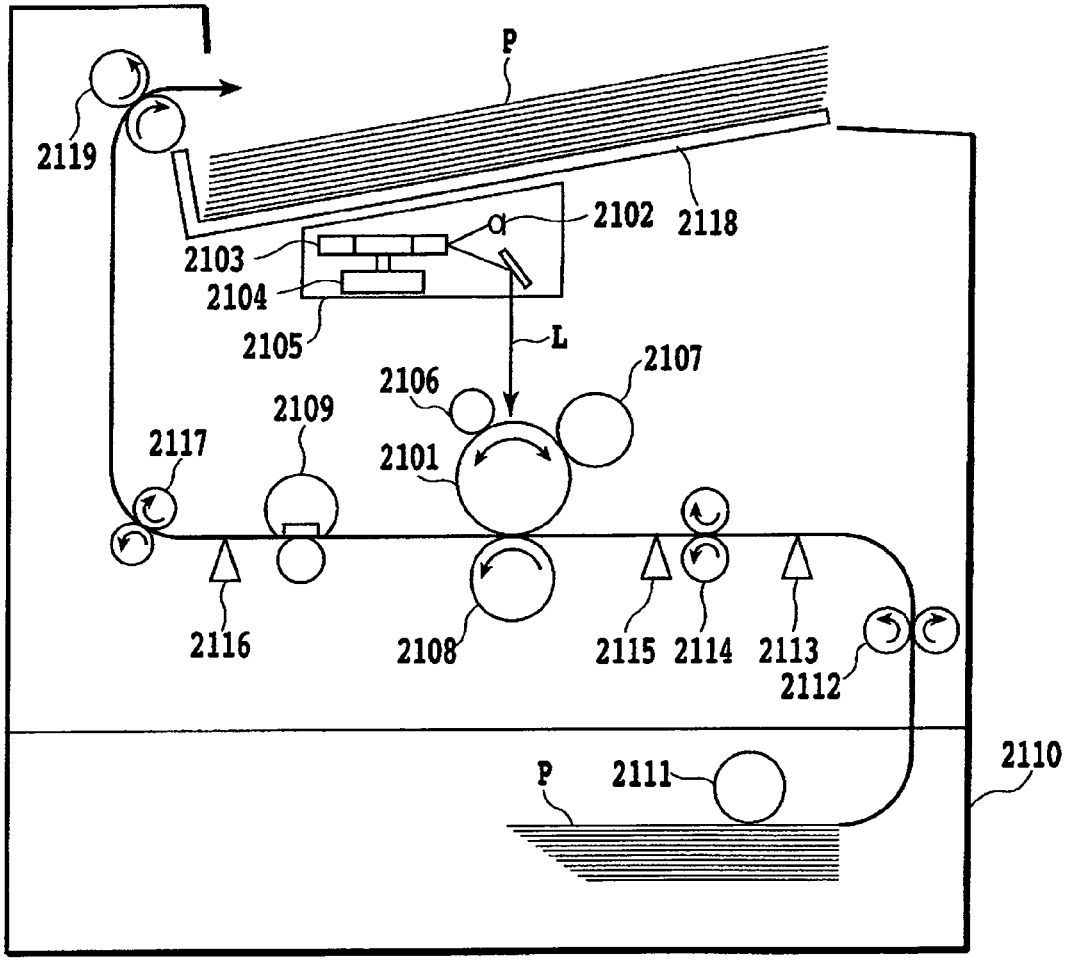
FIG. 12 illustrates a construction of a printer in embodiment 2-1 and 2-2 of this invention.

FIG. 12 is a schematic diagram showing an image forming apparatus in this embodiment. This image forming apparatus is a laser beam printer based on a transfer electrophotographic process.

Denoted 2101 is a photosensitive drum carrying electrostatic charges and 2105 is a laser scanner as an image exposing device. In this laser scanner, reference number 2102 represents a semiconductor laser as a light source, 2103 a rotatable multi-faced mirror that is rotated by a scanner motor 2104, and L a laser beam emitted from the semiconductor laser 2102 and adapted to scan over the photosensitive drum 2101.

Designated 2106 is a charge roller 2106 to uniformly charge the surface of the photosensitive drum 2101. The surface of the photosensitive drum 2101 uniformly charged by the charge roller 2106 is scanned and exposed by the output leaser beam L from the laser scanner 2102 to form an electrostatic latent image of target image information on the photosensitive drum 2101.

Denoted 2107 is a developer that develops the electrostatic latent image formed on the photosensitive drum 2101 with a toner. A transfer roller 2108 transfers the toner image developed by the developer 2107 from the photosensitive drum 2101 onto a desired recording material (hereinafter referred to as a transfer material) P. Designated 2109 is a fusing device (also referred to as a fixing device) that fuses the toner transferred onto the transfer material with heat.

Denoted 2110 is a paper cassette 2110 accommodating a stack of the transfer material P and having a function of distinguishing the size of the transfer material P. Reference number 2111 indicates a cassette paper feed roller which makes one turn to feed a sheet of the transfer material P from the paper cassette 2110 onto a transport path. Designated 2112 are transport rollers to transport the transfer material P fed from the paper cassette 2110.

Reference number 2113 denotes a prefeed sensor to detect front and rear edges of the transfer material P being transported. Reference number 2114 denotes pretransfer rollers to feed the transfer material P to the photosensitive drum 2101 Denoted 2115 is a top sensor to synchronize the image writing (recording/printing) onto the photosensitive drum 2101 with the transport of the transfer material and also to measure the length of the transfer material P in the transport direction. Denoted 2116 is a paper discharge sensor to detect the presence or absence of the transfer material P after being fixed. Reference number 2117 indicates discharge rollers to carry the fixed transfer material P toward a discharge tray 2118. Reference number 2119 denotes paper discharge rollers 2119 for discharging the transfer material P transported from the discharge rollers 2117 onto the discharge tray 2118.

(2) Circuit Configuration of Control System

Figure 13:
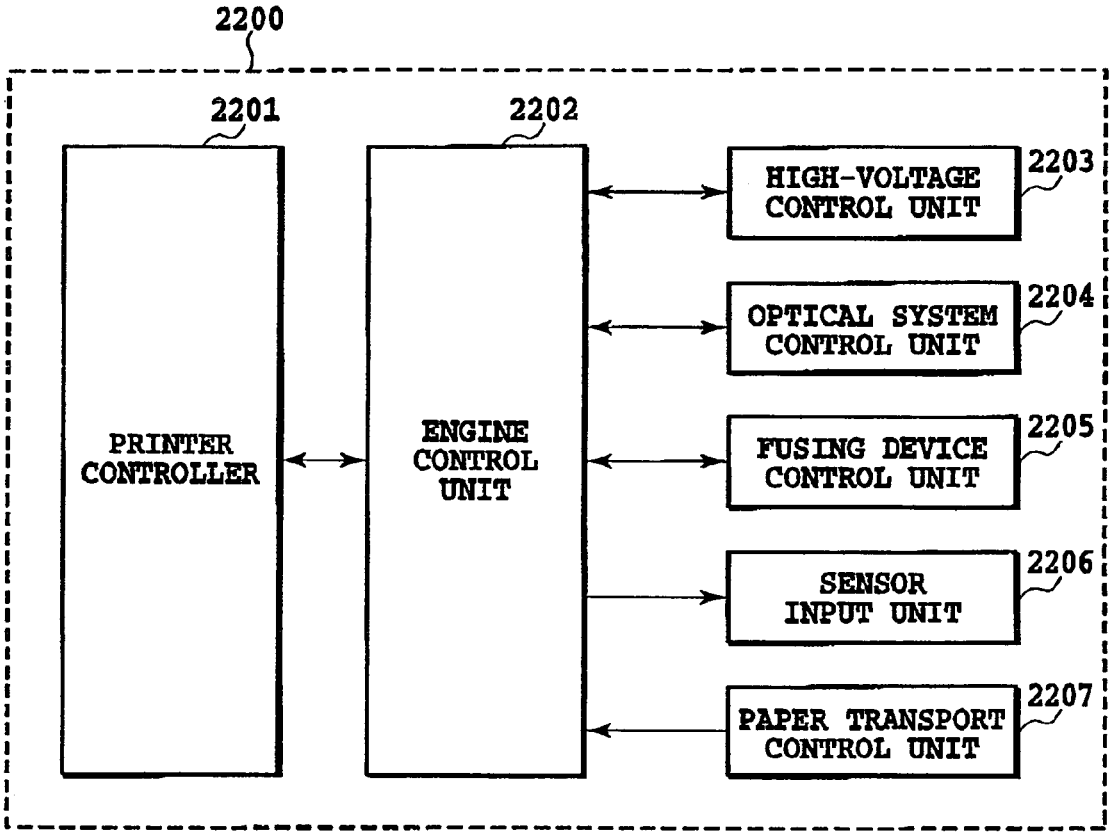
FIG. 13 is a circuit block diagram of embodiment 2-1 and 2-2 of this invention.

A block diagram representing a circuit configuration of a control system that controls the above mechanism is shown in FIG. 13. In FIG. 13, denoted 2200 is a printer. Designated 2201 is a printer controller which develops image code data sent from an external device not shown, such as host computer, into bit data for printing and which reads and displays printer's internal information.

Reference number 2202 represents a printer engine control unit to control various parts of a printer engine for a printing operation according to directions from the printer controller 2201 and to inform the printer internal information to the printer controller 2201.

Reference number 2203 denotes a high-voltage control unit to perform various high-voltage output controls in the charging, developing and transfer processes according to directions from the printer engine control unit 2202.

Reference number 2204 denotes an optical system control unit to control a start/stop of the operation of the scanner motor 2104 and an on/off operation of a laser beam according to the directions from the printer engine control unit 2202.

Reference number 2205 denotes a fusing device control unit to energize or deenergize a heater (fixing heater) of the fusing device 2109 according to directions from the printer engine control unit 2202.

Reference number 2206 denotes a sensor input unit to inform to the printer engine control unit 2202 information on the presence or absence of the transfer material from the prefeed sensor 2113, the top sensor 2115 and the paper discharge sensor 2116. Denoted 2207 is a paper transport control unit which starts/stops the motor and roller for transfer material transport according to directions of the printer engine control unit 2202. The paper transport control unit 2207 controls the starting/stopping of the cassette paper feed roller 2111, transport rollers 2112, pretransfer rollers 2114, rollers of the fusing device 2109 and paper discharge rollers 2119 of FIG. 12.

(3) Fusing Device 109

Figure 14:
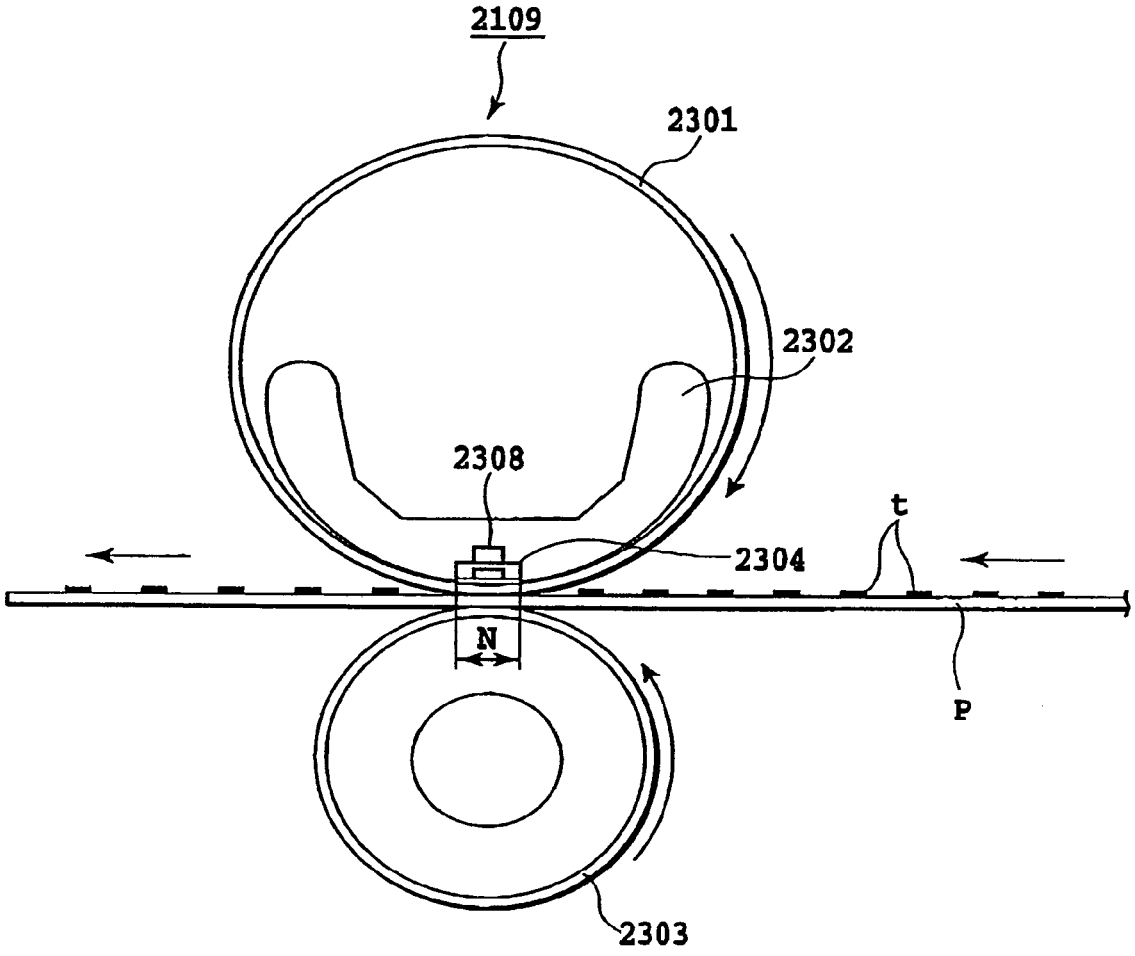
FIG. 14 is a schematic cross-sectional view of a fusing device of embodiment 2-1 and 2-2 of this invention.

FIG. 14 shows a schematic cross-sectional view of the fusing device 2109 according to this invention. The fusing device of this embodiment is of a film heating type using a pressure roller drive method. This fusing device uses a (cylindrical) endless belt of heat resistant film as the heating roller.

Denoted 2301 is a fixing film as a heating roller formed of a (cylindrical) elastic, thin, endless belt 20–150 μm thick, with a release layer formed on the surface. The fixing film 2301 of an endless belt is loosely fitted over a film guide member (stay) 2302 arc-shaped in cross section like a trough. The fixing film 2301 has a small heat capacity to improve a quick start capability.

A pressure roller 2303 as a pressing roller has a PFA tube layer as a release layer on a silicone rubber layer (elastic layer) on a core of iron or aluminum.

A heater 2304 is arranged along the length of the film guide member 2302 and fixedly supported on a central part of the underside thereof. The pressure roller 2303 with some elasticity is pressed against the heater 2304, with the fixing film 2301 interposed therebetween, to form a fixing nip portion N of a predetermined width.

The fixing film 2301 at the fixing nip portion N is applied a frictional rotating torque by the rotary driving of the pressure roller 2303 and, at least during the image fixing process, slides on the surface of the heater 2304 in the fixing nip portion N in a clockwise direction indicated with an arrow while keeping an intimate contact with the heater surface. Therefore, the film 2301 is driven to rotate, without forming a wrinkle, at almost the same circumferential speed as a predetermined circumferential speed (a transport speed of the transfer material P carrying an unfixed toner image that is fed from the image forming unit (transfer unit)).

The heater 2304 is, for instance, a ceramic heater which includes a heating body (ohmic-heating body) that, as a heat source, radiates heat upon being energized. This in turn raises the temperature of the ceramic heater.

When power is supplied to the heating body, the heater 2304 becomes hot. The film 2301 is driven to rotate by the rotating pressure roller 2303. In this state, a transfer material P carrying an unfixed toner image t is introduced between the fixing film 2301 and the pressure roller 2303 in the fixing nip portion N and then gripped and transported by the nip portion. As a result, the transfer material P is brought into an intimate contact with the fixing film 2301 and passes through the fixing nip portion N together with the film in a laminated state.

While the transfer material P passes through the fixing nip portion N, a thermal energy is imparted from the heater 2304 through the film 2301 to the transfer material P, fusing and fixing the toner image t on the transfer material P. The transfer material P, after passing through the fixing nip portion, is separated from the film 2301 before being discharged.

Figure 15A:
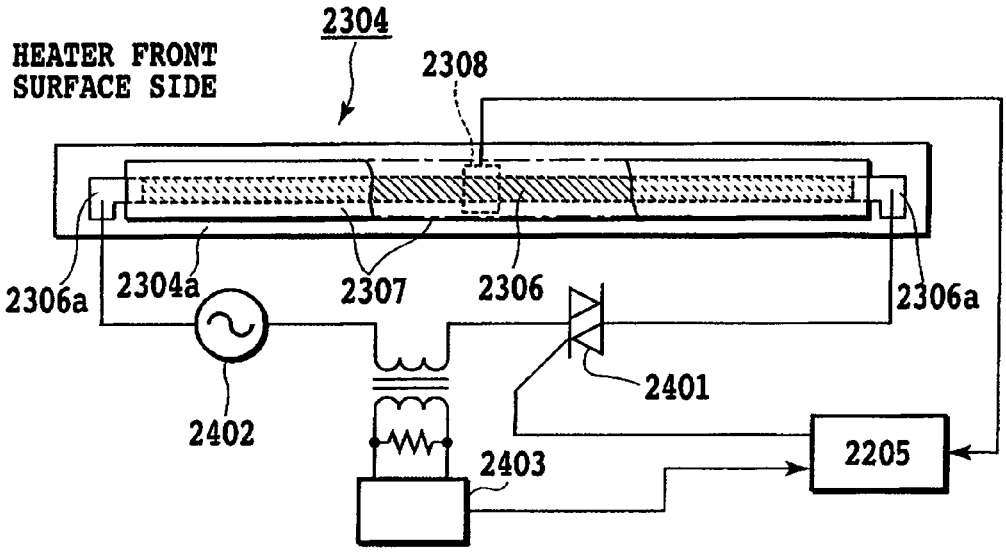
FIGS. 15A to 15C are control block diagrams for embodiment 2-1 and 2-2 of this invention.
Figure 15B:
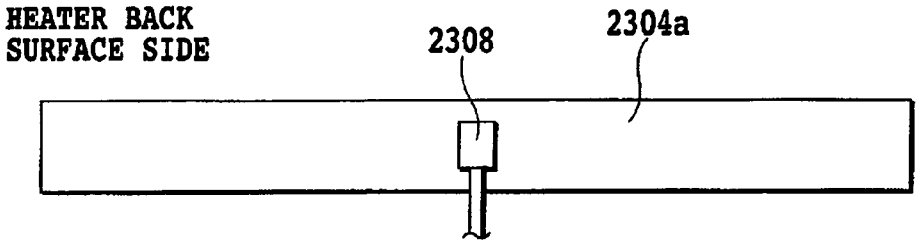
Figure 15C:
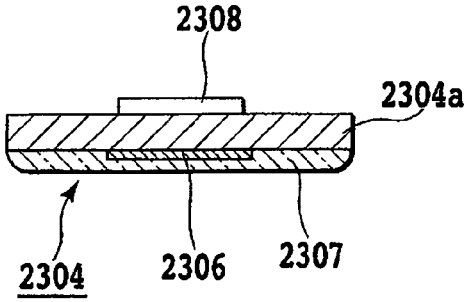

FIG. 15A shows a partly cutaway, schematic plan view of an example ceramic heater as the heater 2304 on the surface side (film sliding side) and a block circuit diagram of a power supply system. FIG. 15B illustrates a partly cutaway, schematic plan view of the heater on the rear side (opposite the film sliding side). FIG. 15C is an enlarged, schematic, transverse cross-sectional view of the heater.

This heater 2304 includes:

(1) a laterally elongate, highly insulating ceramic substrate 2304*a* of alumina, aluminum nitride or silicon carbide, whose longitudinal direction is perpendicular to the paper transport direction (about 0.64 mm thick);

(2) an ohmic heating body (patterned heating body) 2306 printed in a pattern of line or narrow strip, about 10 μm thick and 1–5 mm wide, on the surface of the substrate 2304*a* along its length as by a thick film printing and formed of, for example, Ag/Pd (silver/palladium), $RuO_2$, $Ta_2$, N, etc. having a desired resistance;

(3) electrode portions 2306*a*, 2306*a* electrically connected to the longitudinal ends of the ohmic heating body 2306 and formed of Ag/Pt (silver/platinum);

(4) an insulating, protective sliding layer 2307 provided on the surface of the ohmic heating body 2306 and formed of, for example, an electrically insulating, thin layer of glass coat capable of withstanding a sliding friction with the film 2301; and (5) a temperature sensor 2308, such as thermistor, bonded to the back side of the ceramic substrate 2304*a* to monitor the heater temperature.

This heater 2304 is installed and fixedly supported, with the heater front surface facing outward, in an engagement groove which is formed in an outer surface of the film guide member 2302 at a predetermined position along its longitudinal direction.

The electrode portions 2306*a*, 2306*a* of the heater 2304 are connected to the power feed unit through a power connector (not shown). The ohmic heating body 2306, when energized by the power feed unit, rapidly raises a temperature of the heater 2304. The temperature sensor 2308 detects the temperature of the heater 2304 and feeds back the temperature information to the power feed unit.

That is, what the thermistor 2308 as a temperature sensor has monitored is input to the fusing device control unit 2205. To keep the heater temperature (the fixing nip portion temperature) at a predetermined level, the fusing device control unit 2205 controls a driver 2401 to control the amount of electricity supplied from an ac power supply 2402 to the ohmic heating body 2306 of the heater 2304.

The amount of electricity (or power) supplied to the ohmic heating body 2306 of the heater 2304 is controlled precisely by known means, such as phase control and wave number control, based on the PI (proportional and integral)

control. The PI control determines the amount of power W to be supplied according to the following equation.

$W=A*(I0-I)+X$ (in %; power supplied at full duty is taken to be 100%)

Here, A is a constant (e.g., 5), I0 is a target current, and I is a current detected by a current detection circuit 2403. This portion corresponds to the P control. X increases the amount of power to be fed by 5% when the current monitored at predetermined intervals (e.g., 500 msec) is lower than the target current, and reduces it by 5% when the monitored current is higher than the target current. This corresponds to the I control.

The power W obtained as described above is the PI-controlled power to be supplied to the ohmic heating body 2306.

Figure 16:
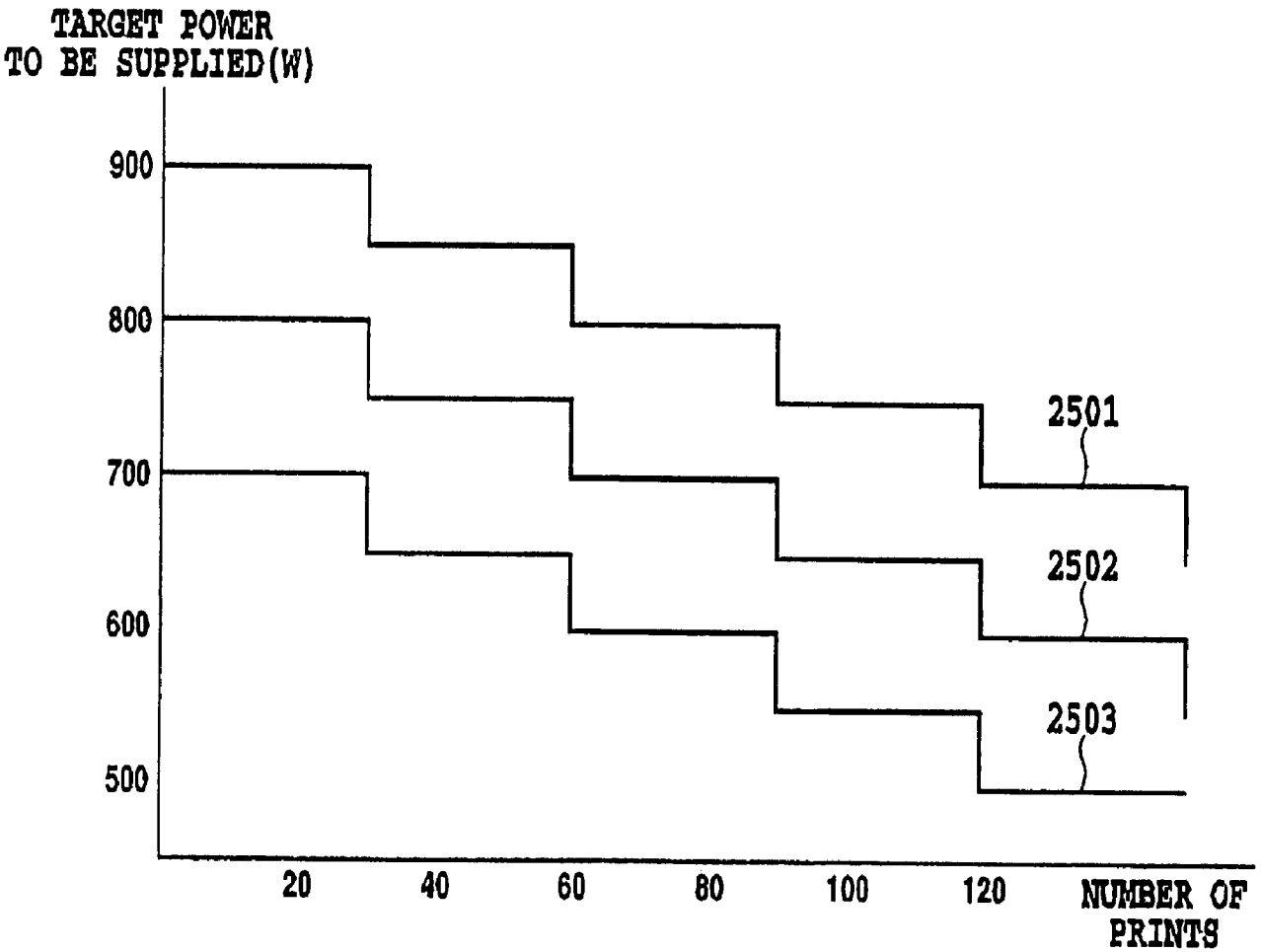
FIG. 16 is a table showing a relation between power to be supplied and the number of sheets to be printed in embodiment 2-1 and 2-2 of this invention.

FIG. 16 is a table showing a relation between power to be supplied to the ohmic heating body 2306 and the number of sheets to be printed in this embodiment. The target power shown in ordinate is calculated from the current flowing in the ohmic heating body 2306 of the heater 2304.

This embodiment uses an algorithm that progressively reduces the power to be supplied to the ohmic heating body 2306 with an increase in the number of sheets to be printed in succession. This is because the pressure roller temperature rises during a continuous printing operation and the required power to obtain a sufficient fixing performance decreases.

This embodiment also adopts a control method which, during an intermittent printing operation, adds a predetermined number to the count of sheets being printed. For example, a second sheet during an intermittent printing corresponds to an 11th sheet during a continuous printing. A decision on whether the printing being performed is an intermittent printing or a continuous printing is made by measuring a time interval between two successive printing operations. In this embodiment, the number to be added to the actual count of printed sheets during the intermittent printing is set to 10 sheets.

Further, when a first printing operation is started, the heater temperature is monitored and, based on that temperature, a virtual printed count is determined.

For example, if at the start of printing a first sheet the heater temperature is less than 85° C., the printing is started at a set temperature for a first sheet; if the heater temperature at the start of the first sheet printing is higher than 85° C., the printing is started at a set temperature for a 21st sheet. After this, during a continuous printing, the count is progressively increased to 22, 23.

In FIG. 16, three lines 2501, 2502, 2503 represent set temperatures for thick paper, normal plain paper and thin paper, respectively. Then the user can make a selection on a control panel not shown as to whether the power is to be controlled in a temperature control mode. This optimizes the supply of power to the heater 2304 according to the thickness of the transfer material P.

It is also necessary to optimize the supply of power to the heater 2304 according to surfaceness or surface roughness of the transfer material P. This is necessary because if the transfer material P has a large surface roughness, a contact area between the fixing film 2301 and the transfer material P decreases making heat transfer to the transfer material P difficult.

Therefore, the amount of power to be supplied to the heater 2304 needs to be increased as the surface of the transfer material P becomes more rough.

Further, in the case of a transfer material P with a coarse surface, the contact area between the fixing film 2301 and the transfer material P is reduced, making heat transfer to the transfer material P difficult. Thus, the detected temperature of the thermistor 2308 installed at the back of the heater tends to increase, exhibiting the characteristic shown in FIG. 17.

Figure 17:
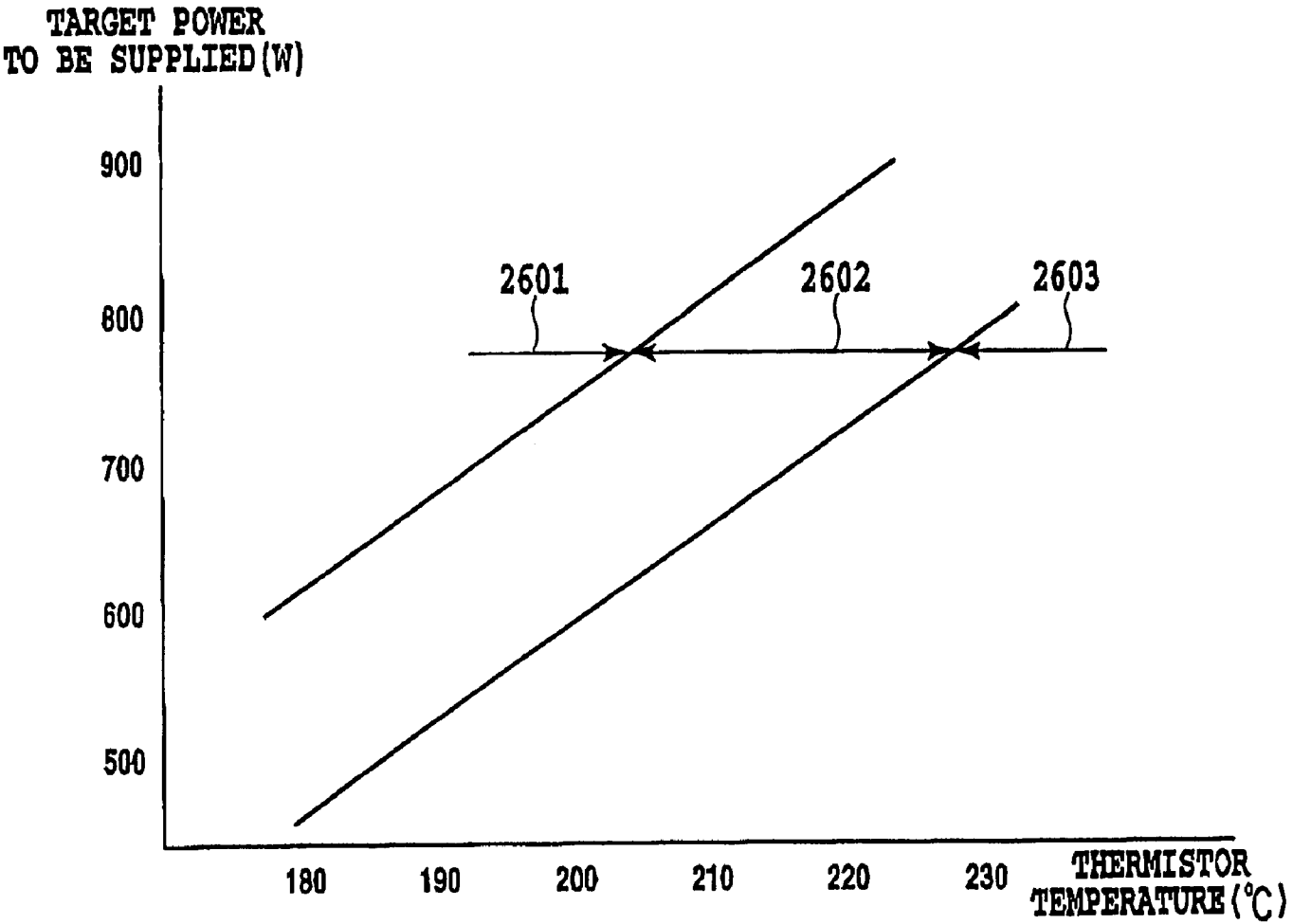
FIG. 17 is a table showing a relation between temperature and power in embodiment 2-1 and 2-2 of this invention.

FIG. 17 is a table showing a relation between temperature and power (calculated from the current flowing in the ohmic heating body 2306 of the heater 2304) in the case of normal plain paper. Reference number 2601 represents a temperature range for PPC paper with a smooth surface (surface roughness Ra: 3.1 μm, grammage: 75 g/m$^2$). 2602 denotes a temperature range for bond paper with a rough surface (surface roughness Ra: 4.0 μm, grammage: 75 g/m$^2$). 2603 denotes a temperature range for laid paper with a more rough surface (surface roughness Ra; 4.5 μm, grammage; 75 g/m$^2$).

Therefore, in this embodiment, the temperature detected by the thermistor 2308 is checked against the surface roughness of the paper (transfer material) in the table of FIG. 17 and the target power in FIG. 16 to be supplied to the heater 2304 is corrected according to the surfaceness of the paper.

That is, the current detection circuit 2403 that monitors the current flowing in the heater 2304 feeds back the monitored current value to the fusing device control unit 2205 as a control means. The fusing device control unit 2205 controls the amount of electricity supplied to the heater 2304 so that the current flowing in the heater 2304 is equal to the predetermined target current value (=target power). If, when the transfer material P passes through the fixing nip portion N, the detected temperature detected by the thermistor 2308 should deviate from the preset temperature range, the fusing device control unit 2205 corrects the preset target current value.

Figure 18:
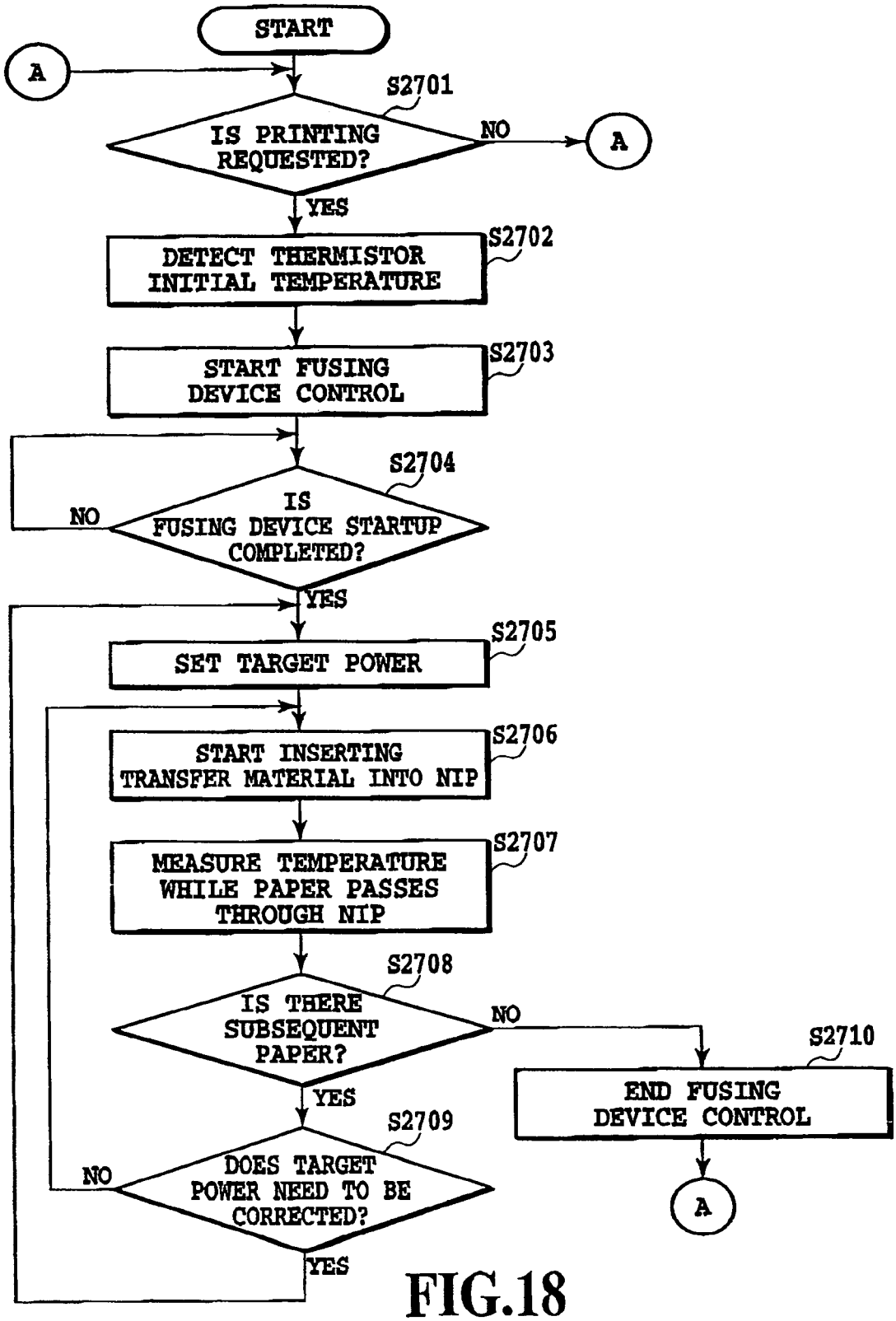
FIG. 18 is a flow chart of embodiment 2-1 of this invention.

This correction method will be explained by referring to the flow chart of FIG. 18 In FIG. 18, a print command is received in step S2701. Then, at step S2702, a thermistor temperature is set to make it possible to decide whether a startup sequence is completed, from an initial temperature detected by the thermistor 2308 and from a fixing mode set by a control panel not shown. At this step a setting is also made of a target power to be supplied when a first sheet at the start of printing passes through the nip portion. At step S2703, the fusing device 2109 is started. At this time the target power is supplied to the heater 2304 at a constant value.

Then, at step S2704 a check is made as to whether the temperature detected by the thermistor 2308 exceeds the temperature set by step S2702. If the set temperature is exceeded, the transfer material P is transported to be inserted into the fusing device 109.

Before the transfer material P enters the fixing nip portion N, the PI control is executed so that the power being supplied becomes equal to the target power of the heater 2304 for the first sheet set by step S2702.

A predetermined time after the transfer material P has begun to enter the fixing nip portion N at step 2706, the temperature of the thermistor 2308 is detected. Step 2708 checks if there are subsequent sheets to be printed. If the subsequent sheets exist, step 2709 decides if the target power needs to be corrected. The correction of the target power is determined according to the table of FIG. 17 using the thermistor temperature detected by step 2707 and the present target power.

Since the transfer material P is contemplated to have a surface roughness similar to that of bond paper, if, with the target power set at 700 W for example, the thermistor detected temperature is less than 190° C., it is decided that power to be supplied is large and the target power is lowered. If the thermistor detected temperature is higher than 215° C. it is decided that the power to be supplied is not sufficient and the target power is raised. The correction of the target power is done by step 2705 to correct the power for the subsequent sheets.

If step 2708 finds that there are no subsequent sheets, the fusing device control is ended at step 2710 and the processing is repeated beginning with step 2701.

The temperature table of FIG. 17 is prepared one for each of normal plain paper, thick paper and thin paper and their characteristic lines are made variable also in the power correction procedure.

As described above, in this embodiment the power to be supplied to the heater 2304 is kept constant and then the surfaceness of the transfer material P is automatically detected from the temperature detected by the thermistor 2308 when the transfer material P passes through the fixing nip portion N. Performing the correction of the power being supplied, based on the detected surfaceness, can provide an optimum print quality including fixing performance for each kind of paper.

That is, in an image fusing device which has power supply means 2205, 2402, 2401 for supplying electricity to the heater 2304, the temperature detection means 2308 for detecting the temperature of the heater surface and the heater current detection means 2403 for detecting a current flowing in the heater and which controls power to be supplied to the heater so that the current flowing in the heater while the transfer material is passed remains constant, the setting value of the current flowing in the heater is made variable so that the heater surface temperature while the transfer material is passed falls within a predetermined range. This arrangement allows an optimum image heating condition (fixing condition) to be set automatically regardless of the kind of transfer material (paper thickness and surfaceness), particularly the surfaceness of the transfer material. This arrangement can also realize power saving.

Embodiment 2-2

In embodiment 2-1 the power to be supplied to the heater 2304 is kept constant and the surfaceness of the transfer material P is detected from the thermistor temperature when the transfer material P is subjected to the fixing process. Then, the power supply to the heater 2304 is controlled so that the amount of heat applied to the transfer material P remains constant regardless of the surfaceness of the transfer material P.

In this embodiment, a temperature control is performed to keep the surface temperature of the heater 2304 constant and, from the current value flowing in the heater 2304, the surfaceness of the transfer material P is detected. Then, the temperature of the heater 2304 is controlled so that the amount of heat applied to the transfer material P remains constant irrespective of the surfaceness of the transfer material P.

This embodiment has the similar construction to that of the printer of embodiment 2-1. A mechanism of the printer is shown in FIG. 12, a printer control block diagram in FIG. 13 and a schematic cross-sectional view of the fusing device in FIG. 14. A fusing device control block diagram is shown in FIGS. 15A to 15C. A table of power supplied to the ohmic heating body 2306 of the heater 2304 according the number of sheets to be printed is shown in FIG. 16. A table representing a relation between temperature and power for normal plain paper is shown in FIG. 17. Detailed explanations are omitted here as they are similar to those of embodiment 2-1

The PI control in this embodiment determines the amount of power to be supplied W according to an equation shown below $$W=A*(T0-T)+X$$

(in %: power supplied at full duty is taken to be 100%)

Here, A is a constant (e.g., 5), T0 is a target current, and T is a temperature detected by a thermistor. This portion corresponds to the P control. X increases the amount of power to be fed by 5% when the temperature monitored at predetermined intervals (e.g., 500 msec) is lower than the target temperature, and reduces it by 5% when the monitored temperature is higher than the target temperature. This corresponds to the I control.

Figure 19:
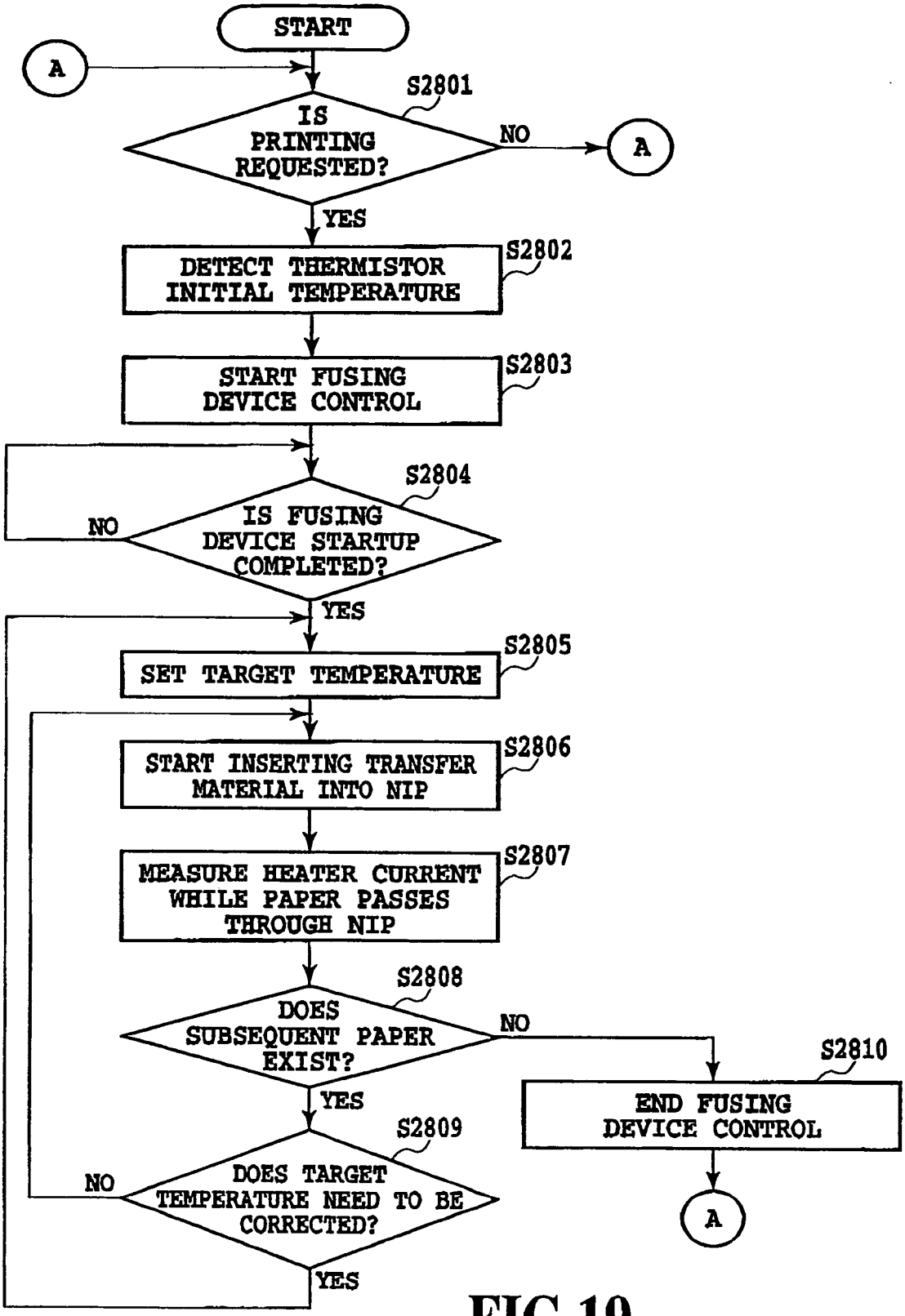
FIG. 19 is a flow chart of embodiment 2-2 of this invention.

In FIG. 19, a print command is received at step 2801. Then, at step 2802, a thermistor temperature is set to make it possible to decide whether a startup sequence is completed, from an initial temperature detected by the thermistor 2308 and from a fixing mode set by a control panel not shown. At this step a setting is also made of a target temperature when a first sheet at the start of printing passes through the nip portion. At step 2803, the fusing device 2109 is started. At this time the heater 2304 is energized so that the heater temperature rises at a constant rate or gradient. The amount of power to be supplied at this stage is determined by the PI control. Then, at step 2804 a check is made as to whether the temperature detected by the thermistor 2308 exceeds the temperature set by step 2802. If the set temperature is exceeded, the transfer material P is transported to be inserted into the fusing device 2109. Before the transfer material P enters the fixing nip portion N, the PI control is executed so that the temperature of the heater 2304 becomes equal to the target heater temperature for the first sheet set by step 2802.

A predetermined time after the transfer material P has begun to enter the fixing nip portion N at step 2806, a current flowing in the heater 2304 is detected. Step 2808 checks if there are subsequent sheets to be printed. If the subsequent sheets exist, step 2809 decides if the target temperature needs to be corrected. The correction of the target temperature is determined according to the table of FIG. 17 using the current value detected by step 2807 and the present target temperature. Since the transfer material P is contemplated to have a surface roughness similar to that of bond paper, if, with the target temperature set at 210° C. for example, the power to be supplied, calculated from the current value, is higher than 800 W, it is decided that power to be supplied is large and the target temperature is lowered. If the power to be supplied, calculated from the current value, is lower than 650 W, it is decided that the power to be supplied is not sufficient and the target temperature is raised. The correction of the target temperature is done by step 2805 to correct the power for the subsequent sheets.

If step 2808 finds that there are no subsequent sheets, the fusing device control is ended at step 2810 and the processing is started again from step 2801.

The temperature table of FIG. 17 is prepared one for each of normal plain paper, thick paper and thin paper and their characteristic lines are made variable also in the power correction procedure.

As described above, in this embodiment the heater surface temperature is kept constant and then the surfaceness of the transfer material P is automatically detected from the current flowing in the heater 2304 when the transfer material P passes through. Correcting the target temperature, based on the detected surfaceness, can provide an optimum print quality including fixing performance for each kind of paper.

Other Embodiments Than 2-1, 2-2

Examples other than embodiments 2-1, 2-2 according to this invention are listed below.

Others

1) The image fusing device of this invention can also be used as a device to heat unfixed toner image on a transfer material for temporary image fixing and as a device to heat the transfer material carrying an image to modify an image surfaceness, such as gloss.

2) In this embodiment a ceramic heater of a construction such as shown in FIGS. 15A to 15C is used as the heater 2304. It is also possible to use ceramic heaters of different constructions. Contact heating bodies using Nichrome wires and electromagnetic induction heating members such as iron plates can also be used without any problem. If an electromagnetic induction heating member is used as a heater, the current flowing in the heater is a current flowing in an excitation coil of that heater.

3) This embodiment uses a contact type thermistor as a means for detecting a temperature of the heater. There is no problem if a non-contact type temperature detection means that senses the temperature through radiation is used. As to the installation position, the temperature detection means may be arranged at other positions than those indicated in this embodiment without affecting the temperature control.

4) The heating roller formed of an endless film is driven by the pressure roller in this embodiment. It is possible to provide a drive roller inside the film to rotate it. Any other driving means may be used to rotate the film.

The film may be a long rolled, both-ended film and may be paid out through the heater.

Further, the film is not limited to a heat resistant resin film and may be a metal film or a composite film.

5) The pressing member is not limited to a roller body and may be a rotating endless belt body.

Embodiment 3-1

Next, a current detection circuit that can be used in embodiments 1-1, 1-2, 2-1 and 2-2 of this invention will be explained.

Figure 20:
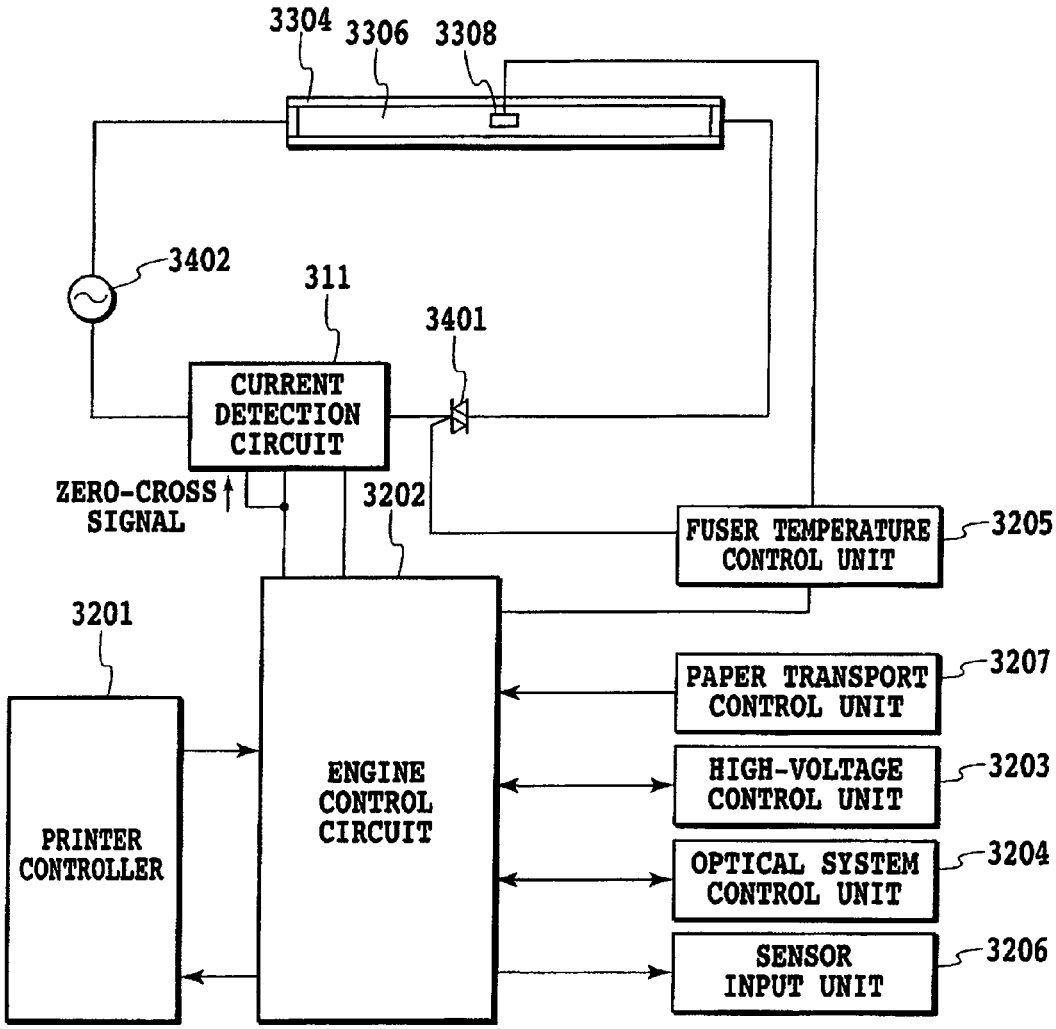
FIG. 20 is a block diagram of embodiment 3-1 of this invention.

FIG. 20 shows embodiment 3-1 of this invention. This illustrates an example laser beam printer incorporating a fusing device (also referred to as a "fixing device"), and its construction is shown in FIG. 21.

Figure 21:
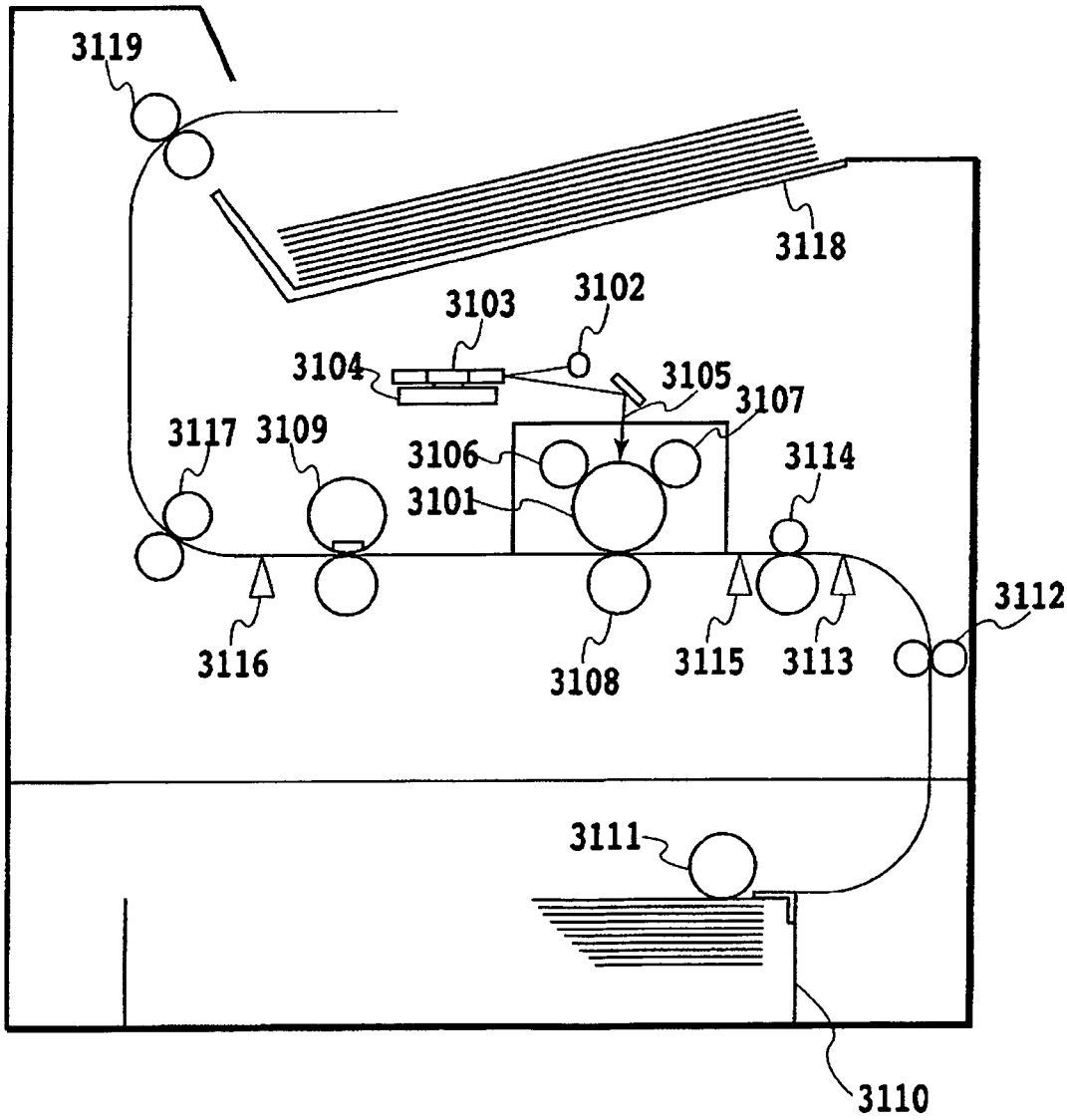
FIG. 21 is a cross-sectional view showing a construction of the laser beam printer of FIG. 20 in embodiment 3-1 of this invention.

Referring to FIG. 21, denoted 3101 is a photosensitive drum as an electrostatic charge carrier, 3102 a semiconductor laser as a light source, 3103 a rotary multi-faced mirror rotated by a scanner motor 3104, and 3105 a laser beam emitted from the semiconductor laser 3102 and adapted to scan over the photosensitive drum 3101. Designated 3106 is a charge roller for uniformly charging a surface of the photosensitive drum 3101, and 3107 is a developer for developing an electrostatic latent image formed on the photosensitive drum 3101 with toner. Reference number 3108 denotes a transfer roller to transfer the toner image developed by the developer 3107 onto a desired transfer material. Reference number 3109 denotes a fixing device to fuse the toner transferred onto the transfer material with heat.

Reference number 3110 represents a paper feed cassette having a function to distinguish paper sizes and accommodating paper. 3111 indicates a paper feed roller for feeding print paper or transfer material from the cassette 3110. 3112 indicates transport rollers to transport the transfer material fed from the cassette 3113 indicates a prefeed sensor to detect front and rear edges of the transfer material being transported. 3114 indicates pretransfer rollers to feed the transfer material to the photosensitive drum 3101. Denoted 3115 is a top sensor to synchronize the image writing (recording/printing) onto the photosensitive drum 3101 with the transport of the transfer material and also to measure the length of the transfer material in the transport direction. Denoted 3116 is a paper discharge sensor to detect the presence or absence of the transfer material after being fixed. Reference number 3117 indicates discharge rollers to carry the fixed transfer material toward a discharge tray 3118. Reference number 3119 denotes paper discharge rollers 3119 for discharging the transfer material transported from the discharge rollers onto the discharge tray 3118.

Figure 22:
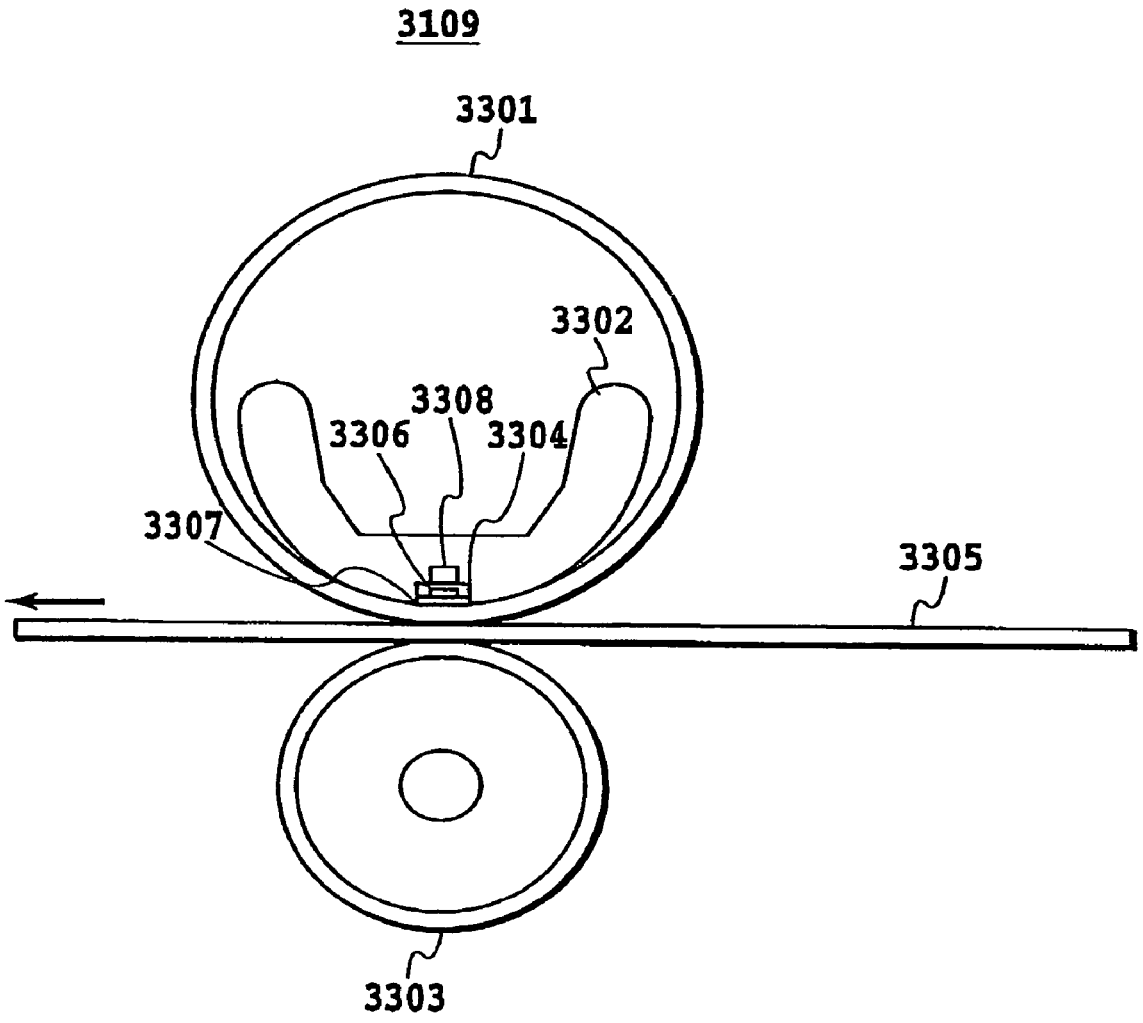
FIG. 22 is a cross-sectional view showing a construction of the fusing device 109 of FIG. 21 in embodiment 3-1 of this invention.

FIG. 22 shows a construction of the fusing device 3109 of FIG. 21. In FIG. 22, designated 3301 is a fixing film as a heating roller formed of an elastic, thin endless belt 20–150 μm thick, with a release layer formed on the surface. The fixing film 3301 of an endless belt is loosely fitted over a film guide member (stay) 3302 arc-shaped in cross section. The use of the fixing film 3301 has resulted in a reduced heat capacity and therefore an improved quick start capability.

A pressure roller 3303 as a pressing roller has a PFA tube layer as a release layer on a silicone rubber layer on a core of iron or aluminum. The film 3301 is driven by the rotating pressure roller 3303 to slide on the surface of the heater 3304, at least during the image fixing process, in a clockwise direction indicated with an arrow while keeping an intimate contact with the heater surface. Therefore, the film 3301 is driven to rotate, without forming a wrinkle, at almost the same circumferential speed as a predetermined circumferential speed (a transport speed of the transfer material 3305 carrying an unfixed toner image that is fed from the image forming unit not shown). The heater 3304 is, for instance, a ceramic heater which includes a heating body (ohmic heating body) 3306 that, as a heat source, radiates heat upon being energized. This in turn raises the temperature of the ceramic heater. When power is supplied to the heating body 3306, the heater 3304 becomes hot. The film 3301 is driven to rotate by the rotating pressure roller. In this state, a transfer material 3305 is introduced into a pressure nip portion N (fixing nip portion) formed between the heater 3304 and the elastic pressure roller 3303. As a result, the transfer material 3305 is brought into an intimate contact with the film 3301 and passes through the fixing nip portion N together with the film in a laminated state.

While the transfer material 3305 passes through the fixing nip portion N, a thermal energy is imparted from the heater 3304 through the film 3301 to the transfer material 3305, fusing and fixing the toner image, on the transfer material 3305. The transfer material 3305, after passing through the fixing nip portion, is separated from the film 3301 before being discharged. The substrate of the heater 3304 is formed of Alumina ($Al_2O_3$) or aluminum nitride (AlN) and printed on its surface with a heater pattern 3306 of silver/palladium having a desired resistance. As a protective and sliding layer against the fixing film, a glass layer 3307 is formed over the heater pattern. The thermistor 3308 as a temperature sensor, which is securely bonded to the back of the substrate, the side opposite the heater pattern side, monitors the heater temperature.

Referring to FIG. 20, reference numbers 3304, 3306 and 3308 represent the portions of the same reference numbers in FIG. 22. Denoted 3201 is a printer controller which develops image code data sent from an external device not shown, such as host computer, into bit data for printing and which reads and displays printer's internal information. Reference number 3202 represents a printer engine control unit to control various parts of a printer engine for a printing operation according to directions from the printer controller 3201 and to inform the printer internal information to the printer controller 3201. Reference number 3203 denotes a high-voltage control unit 3203 to perform various high-voltage output controls in the charging, developing and transfer processes according to directions from the printer engine control unit 3202. Reference number 3204 denotes an optical system control unit to control a start/stop of the operation of the scanner motor 3104 and an on/off operation of a laser beam according to the directions from the printer engine control unit 3202. Reference number 3205 denotes a fusing device control unit to energize or deenergize the fixing heater according to directions from the printer engine control unit 3202. Reference number 3206 denotes a sensor input unit to inform to the printer engine control unit 3202 information on the presence or absence of the transfer material from the prefeed sensor 3113, the top sensor 3115 and the paper discharge sensor 3116. Denoted 3207 is a paper transport control unit which starts/stops the motor and roller for transfer material transport according to directions of the printer engine control unit 3202. The paper transport control unit 3207 controls the starting/stopping of the cassette paper feed roller 3111, transport rollers 3112, pretransfer rollers 3114, rollers of the fusing device 3109 and paper discharge rollers 3119 of FIG. 21.

What the thermistor 3308 as a temperature sensor has monitored is input to the fusing device temperature control unit 3205. To keep the heater temperature (the fixing nip portion temperature) at a predetermined level, the fusing device temperature control unit 3205 controls a driver 3401 to control the amount of electricity supplied from an ac power supply 3402 to the ohmic heating body 3306 of the heater 3304. Denoted 311 is a current detection circuit to detect the amount of electricity to the heating body 3306.

There are some methods available for controlling the amount of electricity. Here, we will explain about a current detection method when a phase control system is used, particularly when a full-wave input signal is used.

Figure 23:
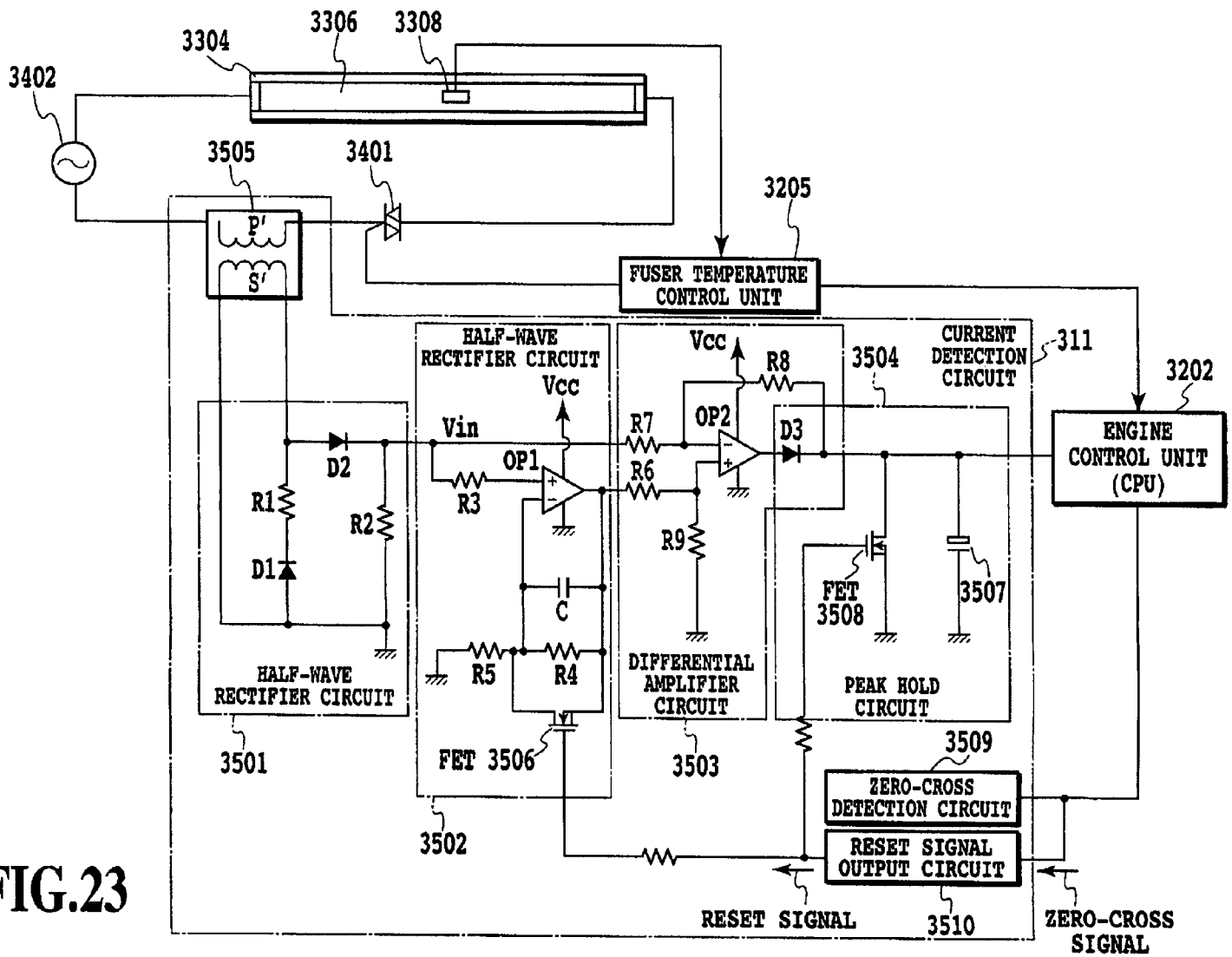
FIG. 23 is a circuit diagram showing a configuration of the current detection circuit 311 of FIG. 20 in embodiment 3-1 of this invention.

FIG. 23 shows a configuration of a current detection circuit 311. In FIG. 23, denoted 3505 is a current transformer which, when an input current flows on a P side, produces a voltage proportional to the number of turns on an S side. Designated 3501 is a half-wave rectifier circuit which has diodes D1, D2 and resistors R1, R2 and half-wave rectifies the voltage produced by the current transformer 3505. Designated 3502 is an integral circuit which includes an operational amplifier OP1, capacitor C, resistors R3, R4, R5 and FET 3506 and integrates an output of the half-wave rectifier circuit 3501. Reference number 3503 is a differential amplifier circuit which includes an operational amplifier OP2, resistors R6, R7, R8, R9 and diode D3 and outputs a difference voltage between an output of the integral circuit 3502 and an output of the half-wave rectifier circuit 3501. Reference number 3504 is a peak hold circuit which has a capacitor 3507 and FET 3508 and holds a maximum value of the differential amplifier circuit 3503.

Designated 3509 is a zero-cross detection circuit which detects when an input supply voltage falls below a predetermined threshold and at the same time produces a pulse signal (referred to as a "zero-cross signal"). Denoted 3510 is a reset signal output circuit which outputs a pulse signal (referred to as a "reset signal") to FETs 3506, 3508 a predetermined time after the zero-cross detection circuit 3509 has output the zero-cross signal.

Figure 24:
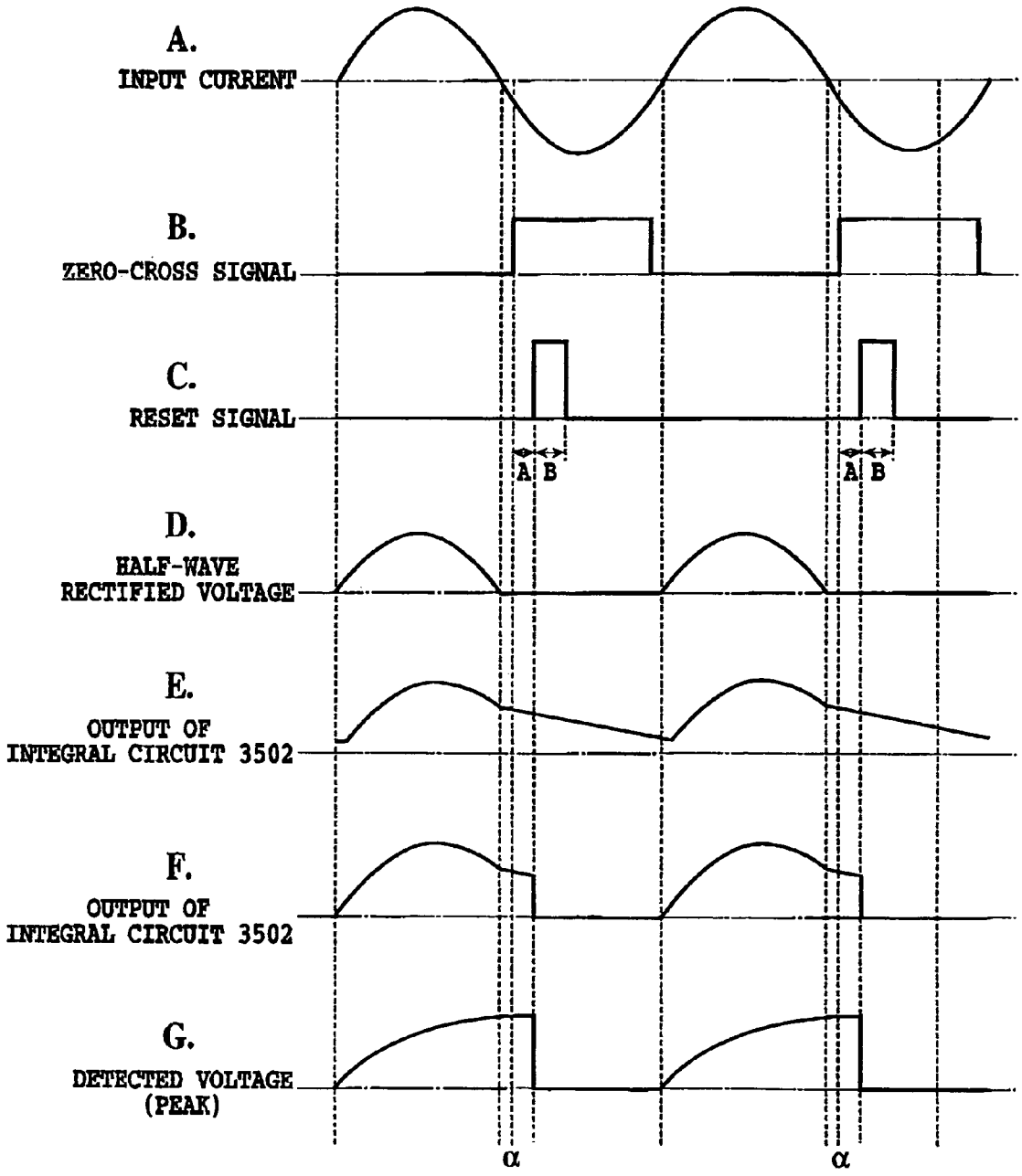
FIG. 24 is example operation waveforms of the current detection circuit 311 of FIG. 23 in embodiment 3-1 of this invention.

Example operation waveforms of the current detection circuit 311 of FIG. 23 are shown in A to G of FIG. 24. When an input current (see A of FIG. 24) flows to the P side of the current transformer 3505 in the half-wave rectifier circuit 3501, a voltage proportional to the number of turns is produced on the S side. This voltage is rectified by the half-wave rectifier circuit 3501 whose output is shown in D of FIG. 24. This rectified voltage waveform is processed by the integral circuit 3502 into a waveform shown in E of FIG. 24. Here, the capacitor C of the integral circuit 3502 needs to be discharged positively and is thus connected with the FET 3506.

Then, a signal to turn on the FET 3506 is output from the reset signal output circuit 3510 a predetermined time after the zero-cross signal (see B of FIG. 24). This delay is provided for the following reason. The output value of the peak hold circuit 3504 is detected by the CPU in the printer engine control unit 3202 at a rising edge a of the zero-cross signal. So, the ON signal is held high (at a logical high level or simply "H") for a predetermined duration several milliseconds (e.g., 2 ms) after the rising edge of the zero-cross signal. While the reset signal (see C of FIG. 24) is high, the capacitor C is discharged resulting in the output of the integral circuit 3502 falling as shown in F of FIG. 24. Since the integral circuit 3502 is formed of non-inverter, the output value of the waveform of F of FIG. 24 is equal to (input voltage Vin+integrated value). Hence, the differential amplifier circuit 3503 subtracts the input voltage Vin (see D of FIG. 24) from the waveform of F of FIG. 24.

For precise detection of the output value of the differential amplifier circuit 3503, the maximum value is held by the capacitor 3507 in the peak hold circuit 3504. To quicken the detection response speed, the capacitor 3507 needs to be discharged positively and is thus connected with an FET 3508. Like the FET 3506, the FET 3508 is also given the reset signal While the reset signal is high the FET 3508 discharges the capacitor C, causing the output value of the peak hold circuit 3504 to fall as shown in G of FIG. 24. As a result, a maximum output value of the peak hold circuit 3504 (see G of FIG. 24) is detected as an output of the input current.

In this embodiment, although we have described a case where the output value of the peak hold circuit 3504 is detected by CPU in the printer engine control unit 3202 at the rising edge $\alpha$ of the zero-cross signal, it is also possible to detect this output value at the rising edge $\alpha$ of the zero-cross signal directly by a control element such as OP amplifier.

While in this embodiment the reset signal 3603 is output from the output circuit, it may instead be output from CPU in the printer engine control unit 3202.

Embodiment 3-2

Next, another embodiment of the current detection circuit that can be used in embodiments 1-1, 1-2, 2-1, 2-2 of this invention will be described.

This embodiment differs from embodiment 3-1 in that it uses a different configuration of the current detection circuit. That is, in embodiment 3-1 the current detection circuit 311 is configured as shown in FIG. 23, whereas in this embodiment a current detection circuit 361 is configured as shown in FIG. 25.

Figure 25:
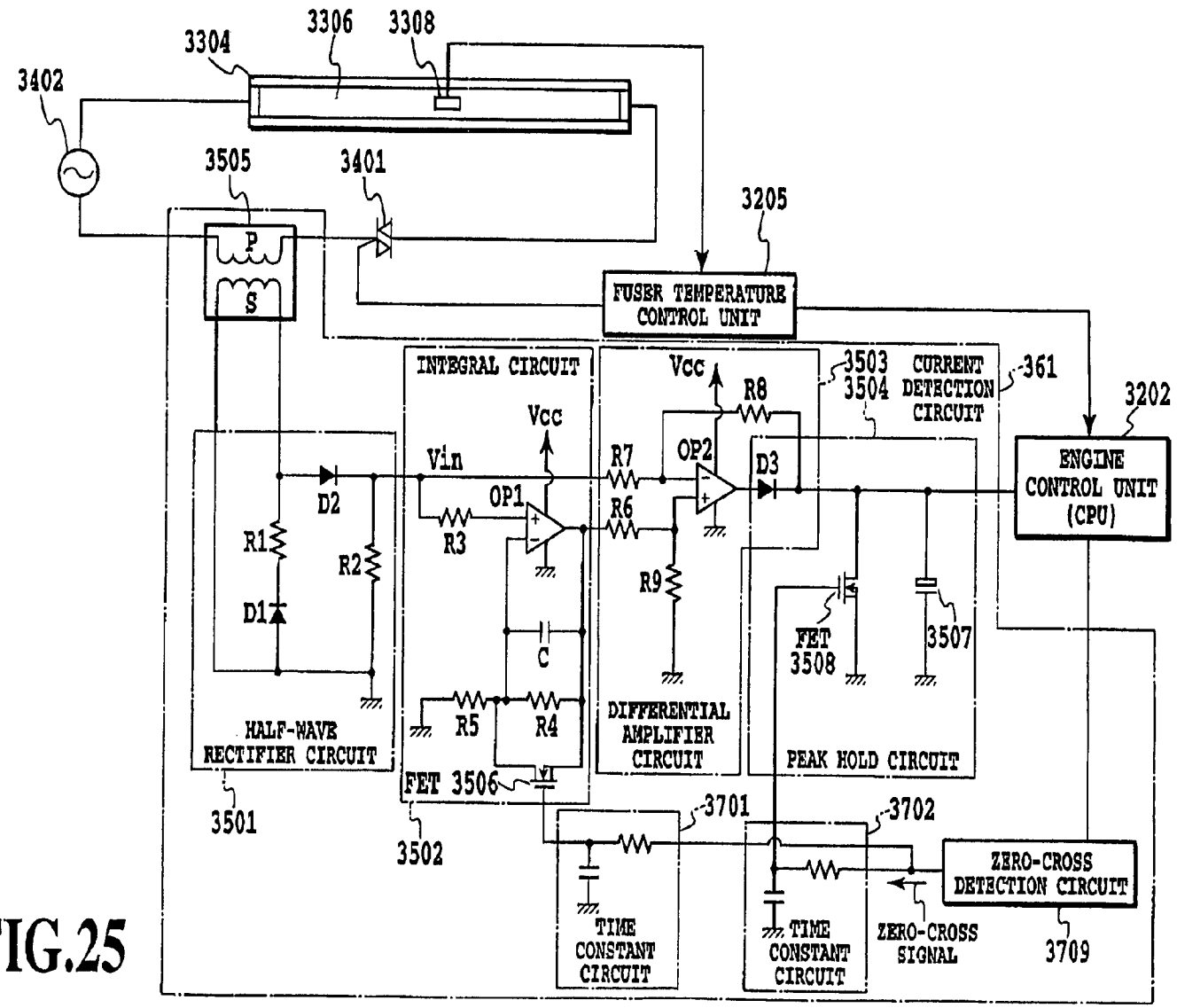
FIG. 25 is a circuit diagram showing a configuration of a current detection circuit 361 of embodiment 3-2 of this invention.

The current detection circuit 361 of FIG. 25 employs a zero-cross detection circuit 3709, a time constant circuit 3701 and a time constant circuit 3702 instead of the zero-cross detection circuit 3509 and reset signal output circuit of FIG. 23. The zero-cross detection circuit 3709, when the input supply voltage falls below a predetermined threshold, supplies a zero-cross signal to the FET 3506 through the time constant circuit 3701 having a resistor and a capacitor. It also supplies the zero-cross signal to the FET 3508 through the time constant circuit 3702 consisting of a resistor and a capacitor.

Figure 26:
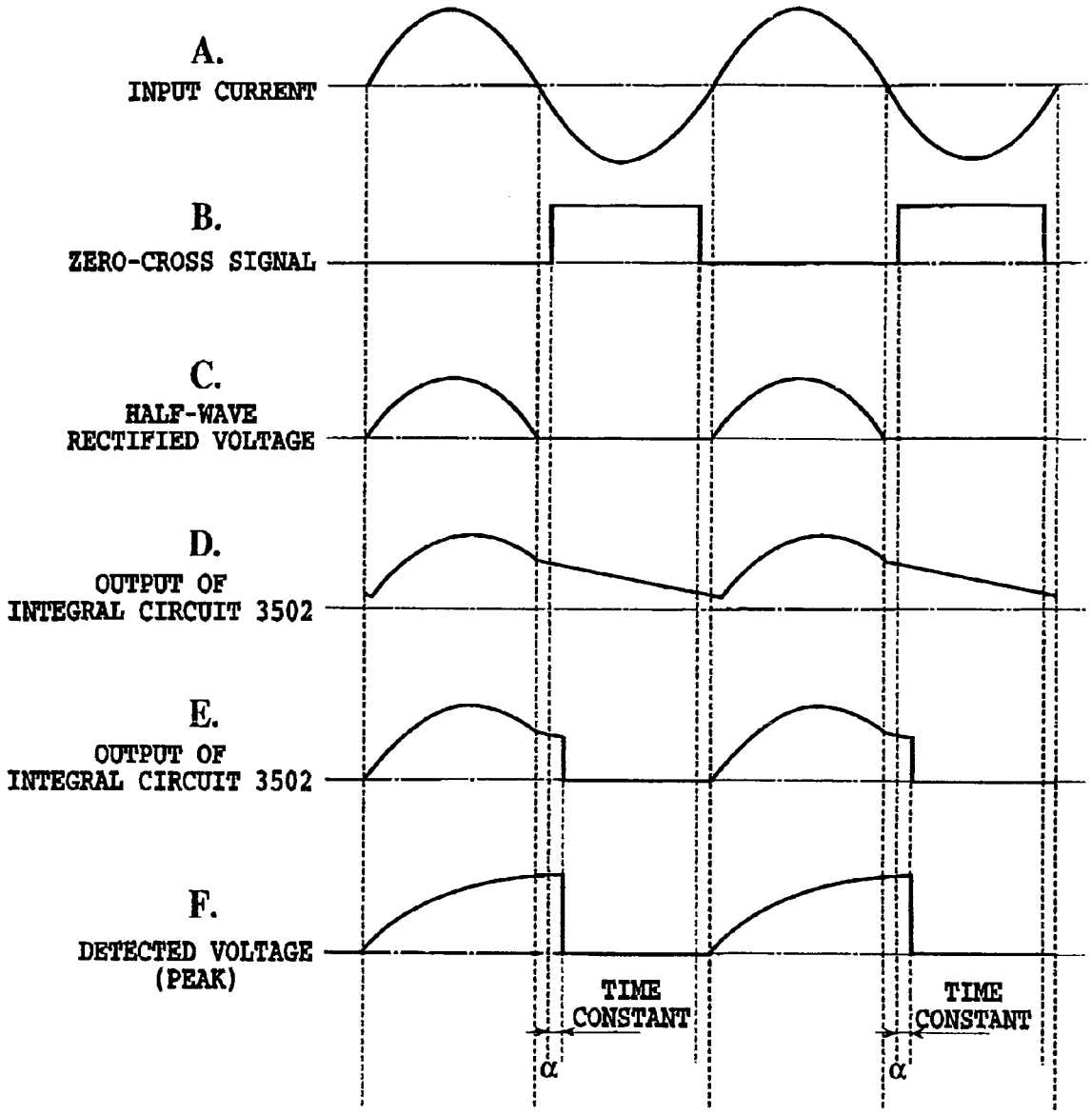
FIG. 26 is example operation waveforms of the current detection circuit 361 of FIG. 25 in embodiment 3-2 of this invention.

A to F FIG. 26 show example operation waveforms of the current detection circuit 361 of FIG. 25. When an input current (see A of FIG. 26) flows to the P side of the current transformer 3505 in the half-wave rectifier circuit 3501, a voltage proportional to the number of turns is produced on the S side. This voltage is rectified by the half-wave rectifier circuit 3501 whose output is shown in C of FIG. 26. This rectified voltage waveform is processed by the integral circuit 3502 into a waveform shown in D of FIG. 26. Here, the capacitor C of the integral circuit 3502 needs to be discharged positively and is thus connected with the FET 3506. Then, a zero-cross signal from the zero-cross detection circuit 3709, a signal to turn on or off the FET 3506, is connected to a gate of the FET 3506 When the zero-cross signal is high, the FET 3506 is turned on to discharge the capacitor C. At this time, the CPU in the printer engine control unit 3202 detects the current at a rising edge $\alpha$ of the zero-cross signal. It is therefore necessary to delay the turn-on of the FET 3506 a predetermined time from the moment the zero-cross signal goes high. For this purpose, the high-level zero-cross signal is supplied to the gate of the FET 3506 through the time constant circuit 3701 constructed of a resistor and a capacitor. An output waveform of the integral circuit 3502 when the capacitor C is discharged is shown in E of FIG. 26.

Since the integral circuit 3502 is formed of non-inverter, the output value (see E of FIG. 26) is equal to (input voltage Vin+integrated value). Hence, the differential amplifier circuit 3503 subtracts the input voltage Vin (see C of FIG. 26) from the waveform of E of FIG. 26.

For precise detection of the output value of the differential amplifier circuit 3503, the maximum value is held by the capacitor 3507 in the peak hold circuit 3504. To quicken the detection response speed, the capacitor 3507 needs to be discharged positively and is thus connected with an FET 3508. Like the PET 3506, the FET 3508 is also given the zero-cross signal While the zero-cross signal is high, the FET 3508 discharges the capacitor C, causing the output value of the peak hold circuit 3504 to fall as shown in F of FIG. 26 As a result, a maximum output value of the peak hold circuit 3504 (see F of FIG. 26) is detected as an output of the input current.

While in this embodiment the output value of the peak hold circuit 3504 is detected by CPU in the printer engine control unit 3202 at the rising edge a of the zero-cross signal, it may also be detected directly by a control element such as OP amplifier.

General Descriptions of Embodiments 3-1, 3-2

Embodiments 3-1, 3-2 of this invention are summarized as follows.

Description 3-1

An image forming apparatus having a fusing device is characterized by:

a current-voltage conversion means for converting an input current to the fusing device into a voltage;

a half-wave rectification means for half-wave rectifying the voltage obtained by the current-voltage conversion means;

an integral means for integrating a half-wave rectified output produced by the half-wave rectification means;

a differential amplification means for amplifying a difference between an integrated result produced by the integral means and the half-wave rectified output;

a maximum value holding means for holding a maximum output of the differential amplification means as a maximum value of the input current;

a first pulse signal output means for outputting a pulse signal when an input supply voltage to the fusing device falls below a predetermined threshold; and a discharge means for discharging a capacitor making up the integral means and a capacitor making up the maximum value holding means in response to the pulse signal from the first pulse signal output means.

Description 3-2

In the description 3-1, the maximum value holding means outputs a maximum value held therein at the rising edge of the pulse signal from the first pulse signal output means.

Description 3-3

In the description 3-1, the first pulse signal output means is replaced with a second pulse signal output means that outputs a pulse signal a predetermined time after the input supply voltage to the fusing device falls below a predetermined threshold.

Description 3-4

In the description 3-3, the maximum value holding means outputs a maximum value held therein at the rising edge of the pulse signal from the second pulse signal output means.

Description 3-5

In the description 3-3, the discharge means discharges a capacitor making up the integral means and a capacitor making up the maximum value holding means in response to the pulse signal from the second pulse signal output means.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A current detection apparatus, comprising:

a current-voltage conversion unit for converting a current to an electric load into a voltage;

a half-wave rectification unit for half-wave rectifying the voltage obtained by the current-voltage conversion unit;

an integral unit for integrating a half-wave rectified output produced by the half-wave rectification unit;

a peak value holding unit for holding a peak value of an output from the integral unit; and a resetting unit for resetting the peak value holding unit at a predetermined timing in each period of an AC power source.

2. An apparatus according to claim 1, wherein the integral unit comprises an integral circuit for integrating a half-wave rectified output produced by the half-wave rectification unit, and a differential amplification unit for amplifying a difference between an integrated result produced by the integral circuit and the half-wave rectified output, wherein the integral circuit comprises a capacitor discharged at a predetermined timing in each period of the AC power source.

3. An apparatus according to claim 1, wherein the peak value holding unit has a capacitor and the resetting unit comprises a timing signal output unit that outputs a timing signal for discharging the capacitor thereby resetting the peak value holding unit.

4. An apparatus according to claim 1, wherein the resetting unit comprises a zero-cross detection circuit and at least one of a reset signal output circuit and a time constant circuit for outputting a signal for resetting the peak value holding unit at a predetermined time after the zero-cross detection timing.

5. An apparatus according to claim 1, further comprising a phase control unit for performing a phase-control of a supply of the AC power source to the electric load.

6. An image forming apparatus using a current detection apparatus according to claim 1, wherein said image forming apparatus has a fusing device for heat-fixing an image on a recording material as the electric load, and the current detection apparatus detects a current supplied to the fusing device.

* * * * *

UNITED STATES PATENT AND TRADEMARK OFFICE

CERTIFICATE OF CORRECTION

PATENT NO. : 7,139,500 B2 
APPLICATION NO. : 11/263987
DATED : November 21, 2006
INVENTOR(S) : Takao Kawazu et al.

It is certified that error appears in the above-identified patent and that said Letters Patent is hereby corrected as shown below:

COLUMN 1:
Line 46, “heater-according” should read --heater according--.

COLUMN 2:
Line 7, “transport Next,” should read --transport. Next,--.

COLUMN 3:
Line 51, “comprises;” should read --comprises:--.

COLUMN 5:
Line 37, “diagrams” should read --diagram--.
Line 42, “diagrams” should read --diagram--.
Line 49, “diagrams” should read --diagram--.
Line 53, “diagrams” should read --diagram--.

COLUMN 9:
Line 6, “SiC.” should read --SiC,--.

COLUMN 10:
Line 24, “that-the” should read --that the--.

COLUMN 14:
Line 42, “2101” should read --2101.--.

COLUMN 18:
Line 35, “FIG. 18” should read --FIG. 18.--.

COLUMN 23:
Line 23, “to” (second occurrence) should be deleted.

COLUMN 24:
Line 24, “a” (second occurrence) should read --α--.
Line 42, “signal” should read --signal.--..

UNITED STATES PATENT AND TRADEMARK OFFICE

CERTIFICATE OF CORRECTION

PATENT NO. : 7,139,500 B2
APPLICATION NO. : 11/263987
DATED : November 21, 2006
INVENTOR(S) : Takao Kawazu et al.

It is certified that error appears in the above-identified patent and that said Letters Patent is hereby corrected as shown below:

COLUMN 25:
Line 31, "3506" should read --3506.--.
Line 56, "signal" should read --signal.--.
Line 59, "FIG. 26" should read --FIG. 26..--.
Line 65, "a" should read --α--.

Signed and Sealed this

Seventeenth Day of July, 2007

JON W. DUDAS
*Director of the United States Patent and Trademark Office*